US009795193B2

(12) United States Patent
Fujita

(10) Patent No.: US 9,795,193 B2
(45) Date of Patent: Oct. 24, 2017

(54) FASTENING TOOL

(71) Applicant: UOAK CO., LTD., Kure-shi, Hiroshima (JP)

(72) Inventor: Tomoko Fujita, Hiroshima (JP)

(73) Assignee: UOAK CO., LTD., Hiroshima (JP)

( * ) Notice: Subject to any disclaimer, the term of this patent is extended or adjusted under 35 U.S.C. 154(b) by 0 days.

(21) Appl. No.: 14/902,321

(22) PCT Filed: Dec. 16, 2014

(86) PCT No.: PCT/JP2014/083300
§ 371 (c)(1),
(2) Date: Dec. 30, 2015

(87) PCT Pub. No.: WO2015/093492
PCT Pub. Date: Jun. 25, 2015

(65) Prior Publication Data

US 2016/0374438 A1 Dec. 29, 2016

(30) Foreign Application Priority Data

Dec. 16, 2013 (JP) ..... 2013-259159

(51) Int. Cl.
*A44B 17/00* (2006.01)
*A41F 1/00* (2006.01)

(52) U.S. Cl.
CPC ..... *A44B 17/0052* (2013.01); *A41F 1/002* (2013.01); *A44B 17/0005* (2013.01);
(Continued)

(58) Field of Classification Search
CPC . Y10T 24/32; Y10T 24/1959; Y10T 24/4696; Y10T 24/3467; Y10T 24/3468; Y10T 24/46; Y10T 24/463; Y10T 24/3469; Y10T 24/4604; Y10T 24/4677; Y10T 24/468; Y10T 24/4602; Y10T 24/4634; Y10T 24/4636; Y10T 24/4638;
(Continued)

(56) References Cited

U.S. PATENT DOCUMENTS 7,356,882 B1 * 4/2008 Guadagno, IV ..... A45F 5/08 24/303
2004/0231212 A1 * 11/2004 Roche ..... B32B 3/06 40/600

(Continued)

*Primary Examiner* — Robert J Sandy
*Assistant Examiner* — Michael Lee
(74) *Attorney, Agent, or Firm* — Hauptman Ham, LLP

(57) ABSTRACT

To provide a fastening tool that can solve problems that are raised upon locking the opening portion of clothing, baggage or the like, and can also positively lock the portion to be locked at a desired position without the necessity of any processing jobs, such as caulking, sewing and the like, so as to be freely detachably locked. The fastening tool is provided with at least a pair of fastening members a and b which have detachably attaching portions that are freely detachably attached to each other, and each of the fastening members a and b has a substrate with a piercing needle formed on one of the surfaces, a bottom plate that is penetrated by the piercing needle, a pierce catch made of a cap-shaped member to cover the tip of the penetrated piercing needle, and detachably attaching portions that are freely detachably engaged with each other.

2 Claims, 19 Drawing Sheets

(52) U.S. Cl.
CPC ..... *A44D 2203/00* (2013.01); *Y10T 24/1959* (2015.01); *Y10T 24/32* (2015.01); *Y10T 24/3468* (2015.01); *Y10T 24/46* (2015.01)

(58) Field of Classification Search
CPC ..... Y10T 24/4648; Y10T 24/1972; A44B 17/0011; A44B 17/0052; A44B 17/0005; A44B 5/02; A44B 19/08; A44B 11/00; A41F 1/002; A45C 13/1069
See application file for complete search history.

(56) References Cited

U.S. PATENT DOCUMENTS

2008/0005873 A1* 1/2008 Barton ..... B43M 15/00 24/303
2010/0263174 A1* 10/2010 Aller ..... B43M 15/00 24/356

* cited by examiner

FASTENING TOOL

RELATED APPLICATIONS

The present application is a National Phase entry of International Application No. PCT/JP2014/083300, filed Dec. 16, 2014, which claims priority of Japanese Application No. 2013-259159, filed Dec. 16, 2013.

FIELD OF THE INVENTION

This invention relates to a fastening tool using a piercing needle with a pierce catch, which is used for freely opening/closing the opening portion of clothing, baggage or the like.

BACKGROUND OF THE INVENTION

Conventionally, a handle as described in Patent Document 1 has been known. In this handle, double rings are formed at the two ends of a grip part, and as shown in FIG. 25 of Patent Document 1, end portions of a wrapping cloth (Furoshiki) folded into a predetermined shape are fixed to these rings so as to be used as a handbag as a whole.

PRIOR-ART DOCUMENTS

Patent Document

PTL 1: Japanese Patent Application Laid-Open No. 2008-110196

SUMMARY OF THE INVENTION

However, in the case when a handbag is formed by using the above-mentioned handle and wrapping cloth, its opening portion into and from which things are put and taken out is kept opened. On the other hand, in the case when normal metal fittings or fasteners are used, a problem is raised in that troublesome processes are required since processing jobs, such as caulking, sewing and the like, need to be carried out.

In order to solve the above-mentioned problem, the fastening tool of the present invention is characterized by including:

a pair of substrates on which piercing needles for penetrating a surface material, such as a material cloth or the like, are formed;

pierce catches that are formed so as to correspond to the paired substrates, and sandwich the piecing needle; and detachable means that is formed on each of the paired substrates so as to make the substrates mutually detachable, and is set such that a force required at the time of detaching is smaller than a force by which the pierce catch holds the piercing needle.

The above-mentioned detachable means is desirably constituted by a male hook formed on one of the substrates and a female hook formed on the other substrate.

Moreover, the above-mentioned detachable means is desirably constituted by a magnet formed on one of the substrates and a magnet or a magnetic member formed on the other substrate.

A convex portion may be formed on one of the substrates and a concave portion corresponding to the convex portion may be formed on the other substrate.

Moreover, the fastening tool of the present invention is characterized by including:

a pair of substrates on which piercing needles for penetrating a surface material, such as a material cloth or the like, are formed;

pierce catches that are formed so as to correspond to the paired substrates, and sandwich the piecing needle; and detachable means that includes a first detachable member formed on the outer periphery of the pierce catch corresponding to one of the substrates, a second detachable member having such a shape as to surround the pierce catch, which is formed on the other substrate, so that the first detachable member and the second detachable member are configured by a combination of mutual magnets or a magnet and a magnetic member.

Furthermore, the fastening tool of the present invention is characterized by including:

a pair of substrates on which piercing needles for penetrating a surface material, such as a material cloth or the like, are formed;

pierce catches that are formed so as to correspond to the paired substrates, and sandwich the piecing needle; and detachable means that includes a first detachable member formed on the outer periphery of the pierce catch corresponding to one of the substrates, a second detachable member having such a shape as to surround the pierce catch, which is formed on the other substrate, and is configured by a male hook formed on one of the first detachable member and the second detachable member and a female hook formed on the other detachable member.

Moreover, a hook that is engaged with a wire is desirably formed on one of the substrates.

Furthermore, the fastening tool of the present invention is characterized by including: a substrate on which a piercing needle for penetrating a surface material, such as a material cloth or the like, is formed;

pierce catches that are formed so as to correspond to the substrate, and sandwich the piecing needle; and a magnet formed on the substrate.

Moreover, detachable means for accessories is preferably formed on the pierce catch or the substrate.

Furthermore, a cap for covering at least a detachably attaching operation portion of the piercing needle is preferably formed on the pierce catch.

BRIEF DESCRIPTION OF DRAWINGS

FIG. 2 is an explanatory view showing a state in which a fastening tool shown in FIG. 1 is attached to an opening portion of a handbag or the like;

DETAILED DESCRIPTION OF THE INVENTION

Referring to attached drawings, the following description will explain embodiments of the present invention based upon respective separated types of a fastening member of a fastening tool. Additionally, in the respective embodiments, with respect to the types, the explanation will be given to types A, B, C and D; however, the fastening tool of the present invention is not intended to be limited by these.

Figure 1:
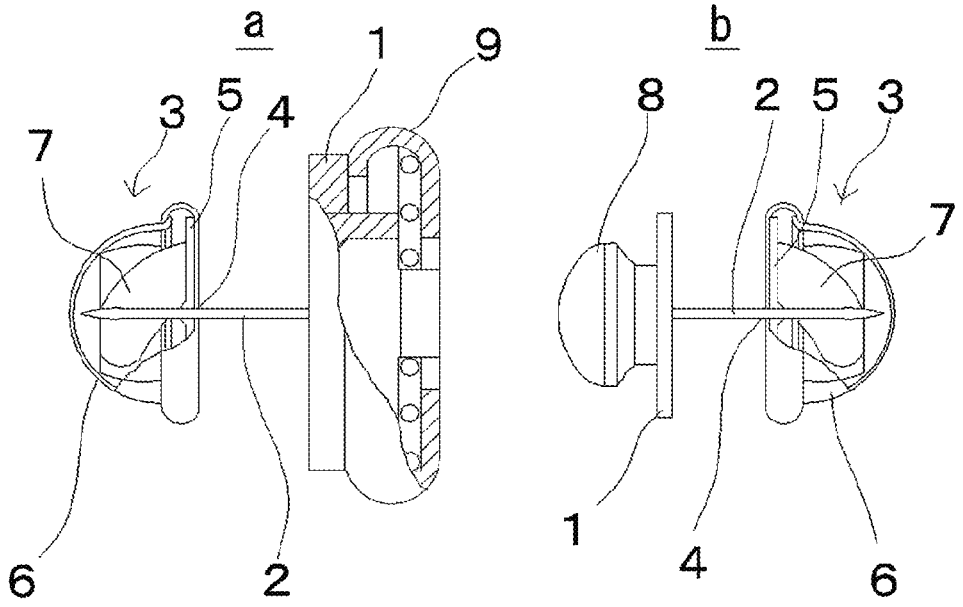
FIG. 1 is a cross-sectional view showing a structure of a fastening tool (A-type) in accordance with an embodiment 1 of the present invention.

FIG. 1 is a partially exploded side view showing a structure of a fastening tool (A-type) in accordance with the present invention. The fastening tool is constituted by a pair of fastening members a and b. Each of these fastening members a and b is provided with a substrate 1 having a piercing needle 2 on its rear surface and a pierce catch 3 that holds the piercing needle 2. The pierce catch 3 is provided with a bottom surface member 5 having a through hole 4 for the piercing needle 2, a holding member 7 (catch member) that extends from the bottom surface member 5 and holds the tip portion of the piercing needle 2, and a casing 6 that houses the bottom surface member 5 and the holding member 7 inside thereof. The substrate 1 is preferably formed into a planar shape. This shape is used because when attached to a material cloth, the material cloth is held between the substrate and the snap pin 3. From this point of view, the surface of the pierce catch 3 on the substrate 1 side is also preferably formed into a planar shape.

Moreover, on the surface of the substrate 1 of the fastening member a, a female hook 9 forming a detachable section is formed. On the surface of the substrate 1 of the fastening member b, a male hook 8 forming the detachable section is formed. As the pierce catch 3, in addition to the above-mentioned structure, those having known structures may also be used.

Figure 2:
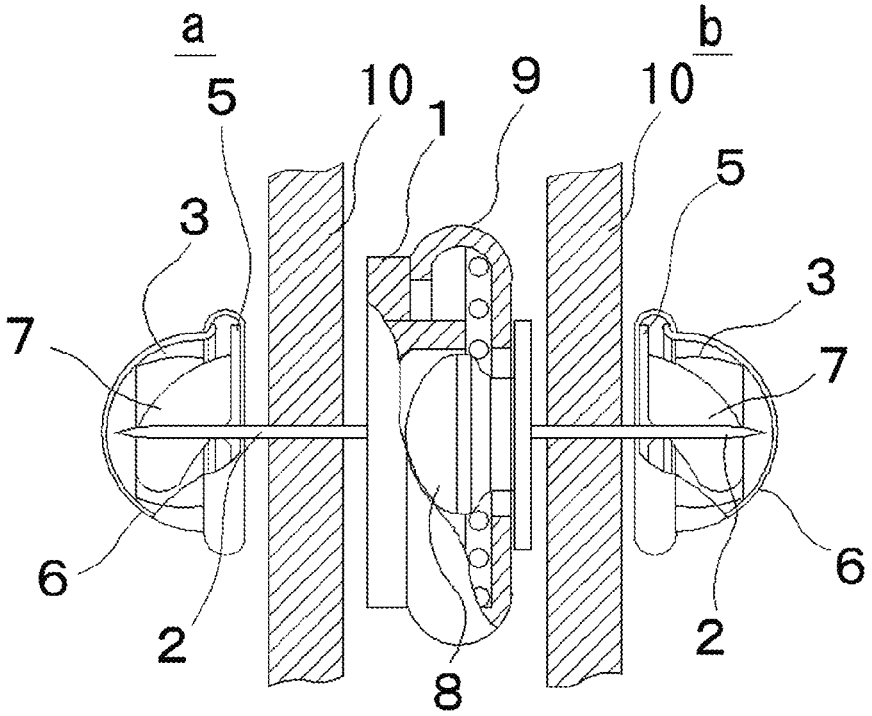

FIG. 2 is an explanatory view showing a state in which the fastening tool as shown in FIG. 1 is attached to an opening portion of a handbag or the like. First, each of the piercing needles 2 formed on the substrates 1 of the fastening members a and b is kept in a state drawn from the pierce catch 3. Next, the piercing needles 2 are made to penetrate opposed material cloths 10 at portions to be engaged with each other of the opening portions, and the tip of each of the piercing needles 2 is allowed to pass through the through hole 4 of the pierce catch 3 so that fastening members a and b are fixed onto the material cloths 10. The fastening members a and b are respectively attached the opposing surfaces of the material cloth 10 on the opening portion. Then, by fitting the male hook 8 and the female hook 9 of the opposing fastening members a and b on the opening portion to each other, the opening portion can be closed. By pulling the male hook 8 and the female hook 9 to be separated from each other, the opening portion can be opened.

By adjusting the force of the spring of the female hook 9, the fitting forces of the male hook 8 and the female hook 9 are made different from each other. In the case when the force of the spring of the female hook 9 is great, upon removing the male hook 8 from the female hook 9, the pierce catch 3 undesirably comes off the piercing needle 2 before the male hook 8 has come off the female hook 9. That is, when the pierce catch 3 is pinched by fingers and pulled, the piercing needle 2 is drawn from the pierce catch 3 in the case when a force for removing the male hook 8 from the female hook 9 is greater than a force by which the piercing needle 2 is held by the pierce catch 3, with the result that the opening portion is not opened. For this reason, in the present invention, with respect to the force of the spring of the female hook 9, the force required for detachably attaching the male hook 8 to the female hook 9 is designed to become smaller than the force by which the piercing needle 2 is held by the piece catch 3.

In accordance with this fastening tool, as long as the material is cloth or leather, the corresponding attaching process can be carried out at any place without requiring any working process. Moreover, since the removing process can be freely carried out, the same material can be used many times. Furthermore, since the attaching process is carried out by the piercing needle, hardly any trace remains on the cloth. By attaching the fastening tool to an existing product, simple cloth can be formed into a muffler, scarf, cloak, or the like with the fastening tool, which is fastened before the neck. Moreover, since it is easily attached to any position, for example, a tote bag is designed to be openable and closable at any desired position to be closed. Furthermore, by using a plurality of fastening tools, a plurality of binding positions may be set.

Embodiment 2

Figure 3:
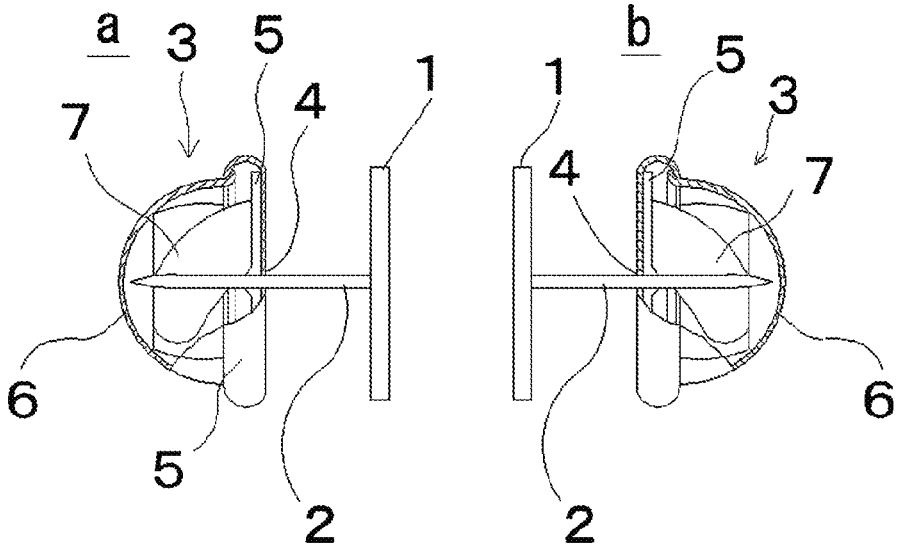
FIG. 3 is a partially exploded side view showing a fastening tool (B-type) in accordance with an embodiment 2 of the present invention.
Figure 4:
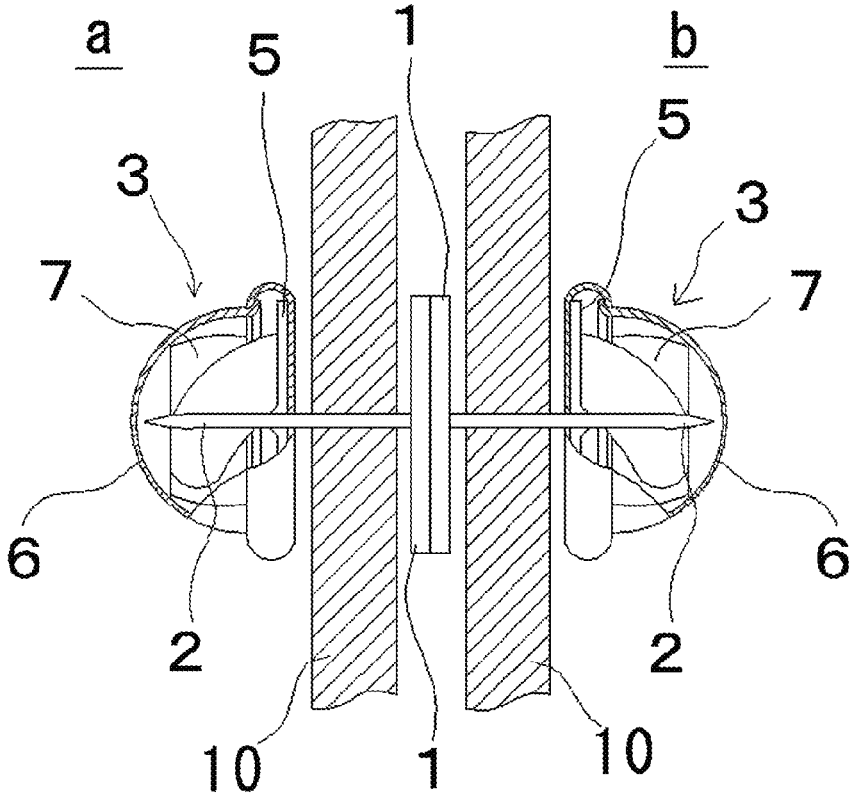
FIG. 4 is an explanatory view showing a using state of the fastening tool shown in FIG. 3.

FIG. 3 is a partially exploded side view showing a fastening tool (B-type) in accordance with an embodiment 2. FIG. 4 is an explanatory view showing a using state of the fastening tool shown in FIG. 3. Additionally, those components that are the same as those of the embodiment 1 are indicated by the same reference numerals and the description thereof will be omitted. The fastening tool in accordance with the present embodiment 2 is characterized in that the substrate 1 of the fastening tool itself, shown in FIG. 3, is formed by using a magnet.

By forming the substrate 1 itself by using a magnet in this manner, the substrates 1 can be easily detachably attached to each other. Additionally, one of the substrates 1 may be formed by a magnet, with the other being formed by a ferromagnetic material. Moreover, the above-mentioned magnet may be formed on the entire surface or one portion of the substrate 1 (the illustration of which is omitted).

In the case when the fastening tool of the present invention is attached to a material cloth 10 and used, the thickness of the substrate 1 is preferably set to such a thickness as not to cause a space between the material cloths 10 and 10. Moreover, the planar shape of the substrate 1 may be formed into various shapes, such as a round shape, a square shape, a rectangular shape, or the like. Furthermore, the number of the piercing needles 2 extended from the substrate 1 may be set to one or a plural number depending on the shape of the substrate 1. Additionally, in the case when a plurality of piercing needles 2 are used, it is supposed that a plurality of pierce catches corresponding to the respective piercing needles 2 are used.

In accordance with this fastening tool, in the same manner as described above, as long as the material is cloth or leather, the corresponding attaching process can be carried out at any place without requiring any working process. Moreover, since the removing process can be freely carried out, the same material can be used many times. Furthermore, since the attaching process is carried out by the piercing needle, hardly any trace remains on the cloth. By attaching the fastening tool to an existing product, simple cloth can be formed into a muffler, scarf, cloak, or the like with the fastening tool, which is fastened before the neck. Moreover, since it is easily attached to any position, for example, a tote bag is designed to be openable and closable at any desired position to be closed. Furthermore, by using a plurality of fastening tools, a plurality of binding positions may be set. In particular, since the detachably attaching action is carried out by using a magnet, the opening and closing actions are easily carried out. By changing the force of the magnet, an optimal opening/closing force can be obtained in accordance with its use.

Embodiment 3

Figure 5:
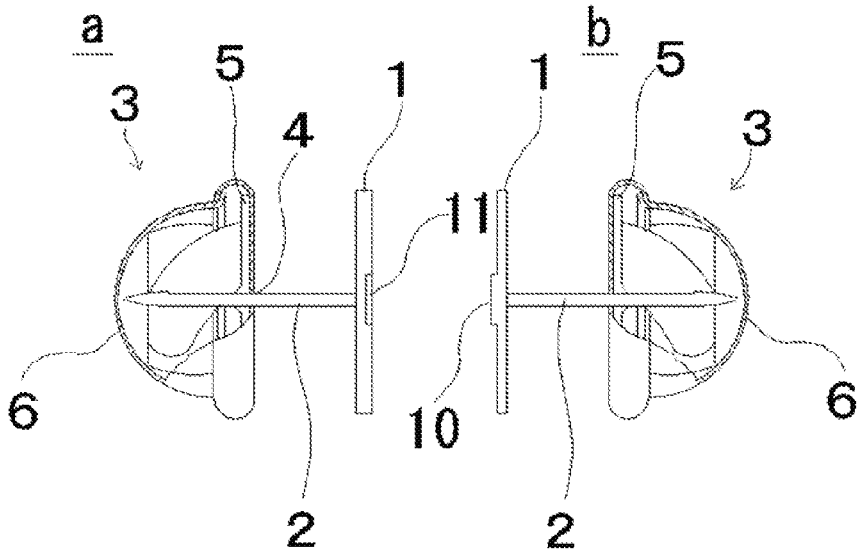
FIG. 5 is a partially exploded side view showing a fastening tool (C-type) in accordance with an embodiment 3 of the present invention.

FIG. 5 is a partially exploded side view showing a fastening tool (C-type) in accordance with an embodiment 3 of the present invention. This fastening tool has a structure in which one of the substrates 1 of the fastening tool of B-type of the embodiment 2 is replaced from a magnet to a magnetic material. Moreover, the present embodiment 3 is characterized in that a concave portion 11 is formed on one of detachably attaching surfaces of the substrate 1, with a convex portion 10 to be fitted to the concave portion 11 being formed on the other detachably attaching surface.

Figure 6:
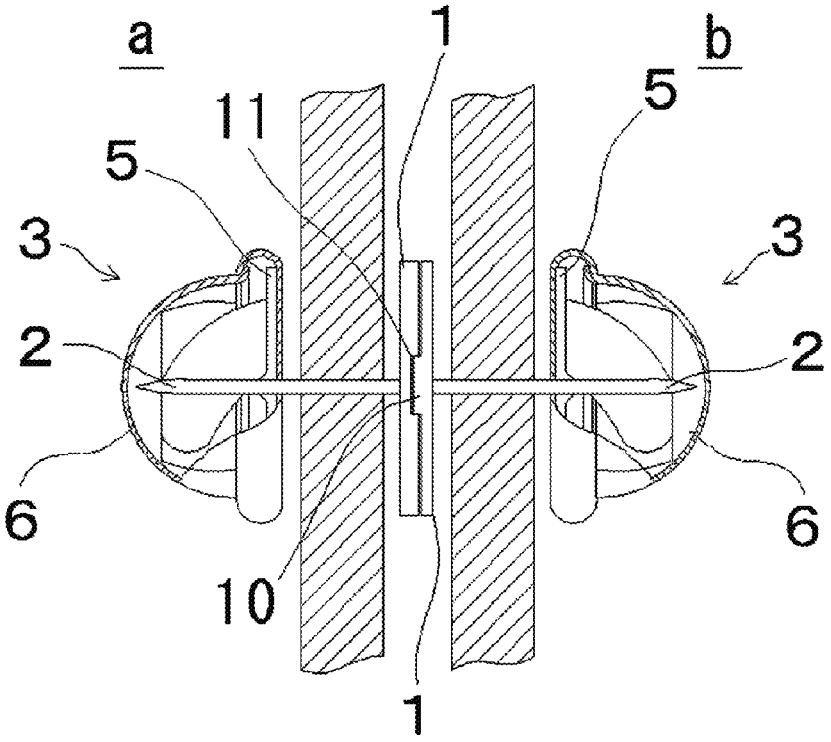
FIG. 6 is an explanatory view showing a using state of the fastening tool shown in FIG. 5.

FIG. 6 is an explanatory view showing a using state of the fastening tool shown in FIG. 5. In this fastening tool, the fastening members a and b of the substrates 1 are attached to a material cloth 10 on the opening portion of clothing or the like by using a piercing needle 2 and a pierce catch 3 in the same sequence of processes as that of the embodiment 1. Since the substrates 1 are respectively formed by the magnet and the magnetic material, they are positively attracted and fixed to each other by mutual attracting functions so that the opening portion can be closed.

Moreover, since the convex portion 10 and the concave portion 11 of the substrates 1 are fitted to each other, the substrates 1 are mutually overlapped with each other correctly and attracted and fixed to each other, without deviations in the plane direction. Furthermore, since the substrates 1 are prevented from being mutually deviated in the plane direction in the attracted and fixed state, it is possible to prevent the opening portion from being opened when a force of displacement is exerted on the opening portion. Additionally, the shapes and numbers of the convex portion 10 and the concave portion 11 may be desirably determined depending on circumstances. Moreover, in the present embodiment, the convex portion 10 and the concave portion 11 are formed on the center of the substrate 1; however, the present invention is not intended to be limited by this structure. For example, the convex portion 10 and the concave portion 11 having a round doughnut shape may be formed, with the surfaces of the substrates 1 being firmly attracted and fixed to each other in the center. Moreover, by forming the convex portion 10 and the concave portion 11 with desired angles in the circumferential direction of the substrates 1, it becomes possible to prevent the substrates 1 from mutually rotating, and consequently to be firmly attached and fixed to each other (illustrations of any of modified examples are omitted).

In accordance with this fastening tool, in the same manner as described above, as long as the material is cloth or leather, the corresponding attaching process can be carried out at any place without requiring any working process. Moreover, since the removing process can be freely carried out, the same material can be used many times. Furthermore, since the attaching process is carried out by the piercing needle, hardly any trace remains on the cloth. By attaching the fastening tool to an existing product, simple cloth can be formed into a muffler, scarf, cloak, or the like with the fastening tool, which is fastened before the neck. Moreover, since it is easily attached to any position, for example, a tote bag is designed to be openable and closable at any desired position to be closed. Furthermore, by using a plurality of fastening tools, a plurality of binding positions may be set. In particular, since the detachably attaching process is carried out by using a magnet, the opening/closing action can be easily carried out. By changing the force of the magnet, it is possible to obtain an optimal opening/closing force in accordance with the use.

Embodiment 4

Figure 7:
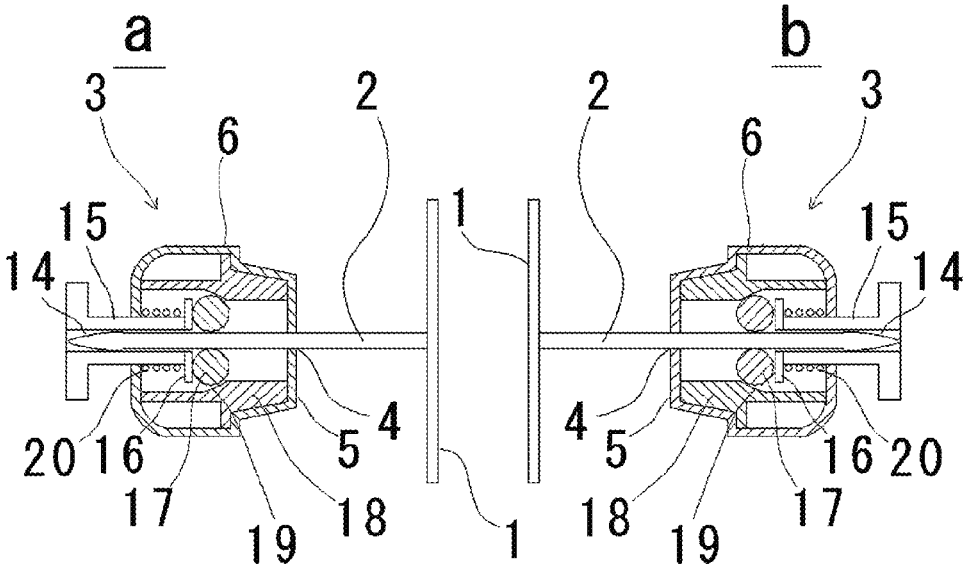
FIG. 7 is a partially exploded side view showing a fastening tool (B-type) in accordance with an embodiment 4 of the present invention.

FIG. 7 is a partially exploded side view showing a fastening tool (B-type) in accordance with an embodiment 4. This fastening tool is characterized in that its pierce catch has a ball catch structure that is different from the pierce catch 3 of the embodiments 2 and 3.

The pierce catch 3 of this fastening tool is constituted by a casing 6 having an insertion opening 4 through which the piercing needle 2 is inserted and which is formed on the bottom surface member 5, a grip member 15 that is disposed on a ceiling portion of the casing 6 so as to penetrate it, and is pinched by fingers so as to be moved in the shaft direction and a tube-shaped member 18 that is secured onto the inside of the casing 6. The casing 6 is used for housing the inner structural members and for protecting them, and has such a shape as to make the appearance design beautiful. The grip member 15 has a through hole 14 in the center in the shaft direction so as to pass the piercing needle 2 therethrough. Moreover, a washer-shaped pressing member 16 is formed on the end portion of the grip member 15. A flange is formed on the other end of the grip member 15 so as to be easily grabbed by fingers. A spring 20 is disposed between the pressing member 16 and the housing 6, and the pressing member 16 is pressed by the spring 20 in the direction toward the bottom surface member 5. The tube-shaped member 18 has a slanting wall 19 having a truncated cone shape the diameter of which is expanded toward the ceiling direction (right direction in the Figure) at the end portion thereof. The tube-shaped member 18 may be integrally formed with the casing 6. Between the slanting wall 19 and the pressing member 16, a plurality of ball members 17 are disposed so as to sandwich and hold the piercing needle 2. The number of the ball members 17 is set to two or more.

Figure 8:
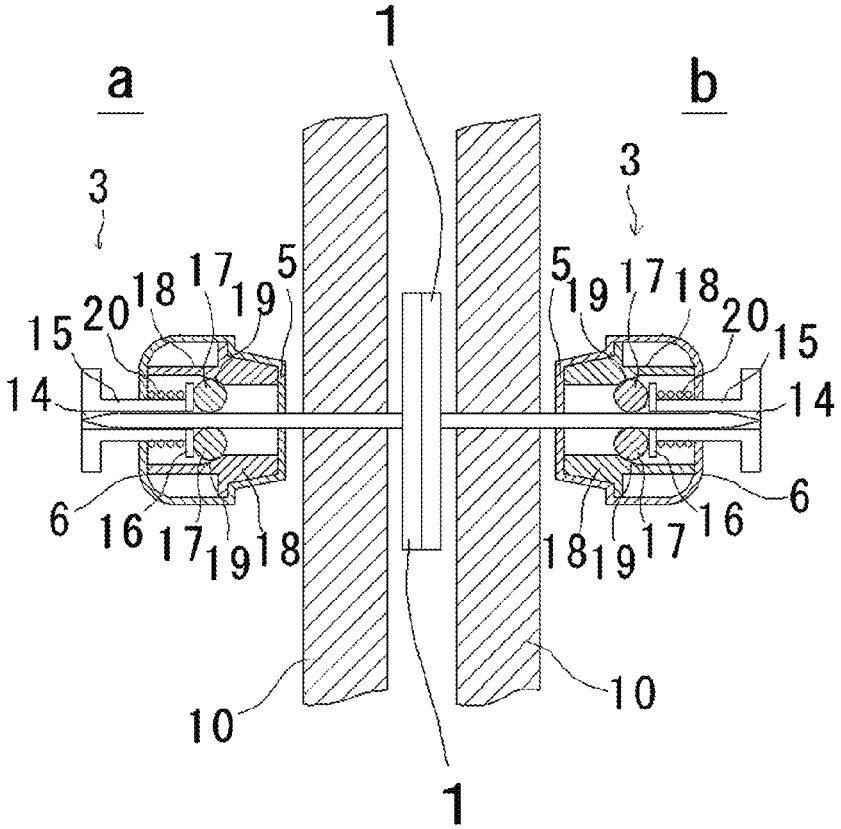
FIG. 8 is an explanatory view showing a using state of the fastening tool shown in FIG. 7.

FIG. 8 is an explanatory view showing the using state of the fastening tool shown in FIG. 7. When the flange of the end portion of the grip member 15 is held by fingers and pulled, the restricted state of the ball members 17 by the pressing member 16 and the slanting wall 19 is released. In this state, when the piercing needle 2 is inserted from the insertion opening 4 of the casing 6, the piercing needle 2 is allowed to pass between the opposed ball members 17, and inserted into the through hole 14 of the grip member 15.

Next, when the grip member 15 is released from the hand, the ball members 17 are pushed by the pressing member 16 by the action of the spring 20 so that the ball members 17 are successively pushed in the center direction along the slanting wall 19. Thus, the ball members 17 are pressed onto the piercing needle 2 so that the ball members 17 sandwich and hold the piercing needle 2. Even upon trying to draw the piercing needle 2 in this state, since the ball members 17 are pushed by the slanting wall 19 in such a direction as to further sandwich the piercing needle 2, the piercing needle 2 is not drawn.

On the other hand, in the case when the piercing needle 2 is drawn, the flange of the grip member 15 is pinched by fingers and pulled, the sandwiched state of the piercing needle 2 by the ball members 17 is released so that the piercing needle 2 can be easily drawn out.

As described above, since the fastening tool of the present embodiment 4 allows the ball members 17 or the like to firmly sandwich and hold the piercing needle 2, it is possible to prevent the pierce catch 3 from coming off at the time of opening/closing the opening portion. Therefore, even in the case of a severe usage such as a tote bag or the like, the pierce catch 3 is prevented from coming off the material cloth. On the other hand, by pulling the grip member 15, the pierce catch 3 can be easily removed.

Moreover, in accordance with the fastening tool, in the same manner as described above, as long as the material is cloth or leather, the corresponding attaching process can be carried out at any place without requiring any working process. Moreover, since the removing process can be freely carried out, the same material can be used many times. Furthermore, since the attaching process is carried out by the piercing needle, hardly any trace remains on the cloth. By attaching the fastening tool to an existing product, simple cloth can be formed into a muffler, scarf, cloak, or the like with the fastening tool, which is fastened before the neck. Moreover, since it is easily attached to any position, for example, a tote bag can be designed to be openable and closable at any desired position to be closed. Furthermore, by using a plurality of fastening tools, a plurality of binding positions may be set. In particular, since the detachably attaching process is carried out by using a magnet, the opening/closing action can be easily carried out. By changing the force of the magnet, it is possible to obtain an optimal opening/closing force in accordance with the use.

Embodiment 5

Figure 9:
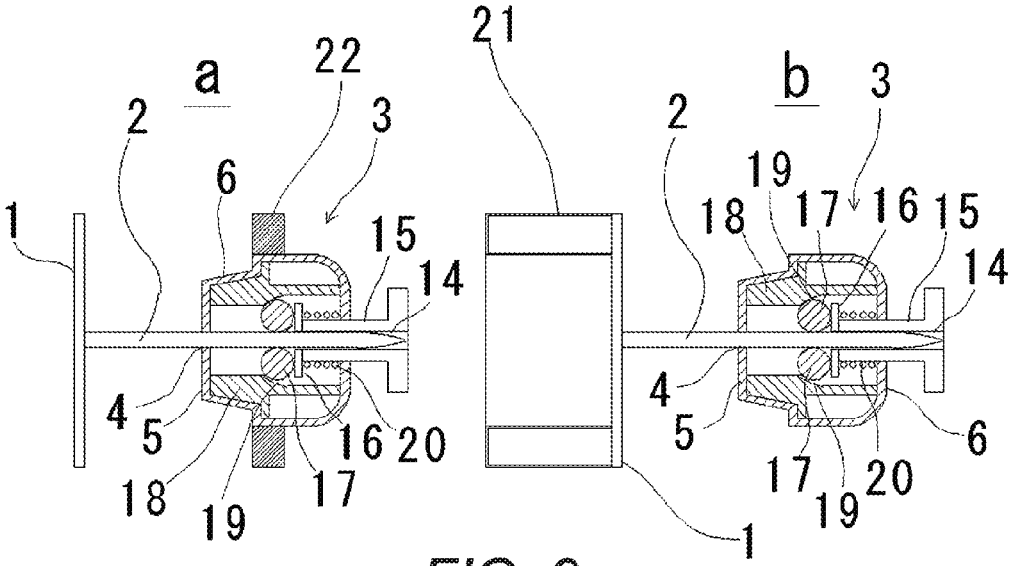
FIG. 9 is a partially exploded side view showing a fastening tool (D-type) in accordance with an embodiment 5.
Figure 10:
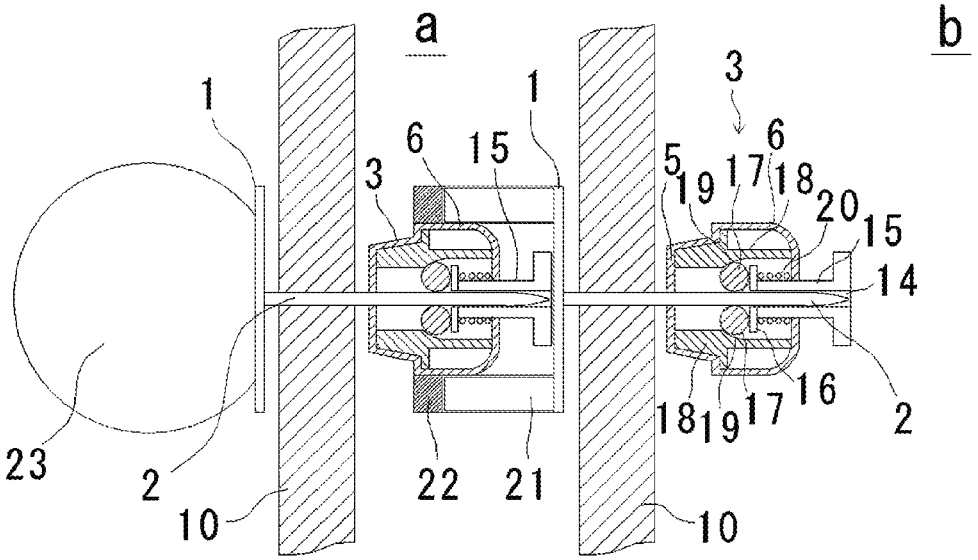
FIG. 10 is an explanatory view showing a using state of the fastening tool shown in FIG. 9.

FIG. 9 is a partially exploded side view showing a fastening tool (D-type) in accordance with an embodiment 5. FIG. 10 is an explanatory view showing the using state of the fastening tool shown in FIG. 9. One of the fastening member a of the fastening tool has a structure in which a ring-shaped magnet 22 (first detachably attaching member) is formed near the center of the peripheral portion of the casing 6 in a vertical direction relative to the formation direction of the through hole 14 and the substrate 1 having a plate-like shape is formed, with the piercing needle 2 being extended from its center. The substrate 1 may be made of either a non-magnetic material or a magnetic material. The ring-shaped magnet 22 is formed into a doughnut shape and a required magnetic force is obtained depending on its diameter and thickness. Moreover, the ring-shaped magnet 22 may be coated with a cover (not shown). Furthermore, the shape in the vicinity of the center of the peripheral portion of the casing 6 may be designed so as to be expanded in a vertical direction relative to the through hole 14, with the above-mentioned members being installed therein (not shown). Additionally, as will be described later, since it is only necessary for the pierce catch 3 to be concealed by a doughnut-shaped member 21, it is only necessary to form the ring-shaped magnet 22 so as to have a size larger than the casing.

Since the inner structure of the pierce catch 3 is the same as that of the pierce catch 3 shown in the embodiment 4, the same components are indicated by the same reference numerals and the description thereof will be omitted.

On the other hand, the fastening member b has a structure in which the doughnut-shaped member 21 (second detachably attaching member) is formed on the surface of the plate-like substrate 1. The piercing needle 2 is extended from the center of the substrate 1. The piercing needle 2 is sandwiched and held by the pierce catch 3. The doughnut-shaped member 21 is molded into a tube-shape from a magnetic metal plate. The doughnut-shaped member 21 may have a solid structure or a hollow structure (not shown). Moreover, the shape and area of the end face of the doughnut-shaped member 21 are desirably formed so as to have substantially the same shape and area as the ring-shaped magnet 22 from the functional point of view as well as from the appearance point of view. The doughnut-shaped member 21 may be integrally formed with the substrate 1. Furthermore, the length in the shaft direction (lateral direction, length direction of the piercing needle 2 in the Figure) of the doughnut-shaped member 21 is supposed to be greater than a length from the end face of the ring-shaped magnet 22 to the other end of the grip member 15. Thus, the casing 6 of the pierce catch 3 can be housed by the doughnut-shaped member 21. In this case, the shape of the doughnut-shaped member 21 may be freely set as long as it can house the casing 6 and is magnetically attracted by the ring-shaped magnet 22. The inside shape of the doughnut-shaped member 21 is preferably set to have substantially the same shape as the outer shape of the casing 6. As shown in FIG. 10, since the casing 6 is inserted inside of the doughnut-shaped member 21 without a gap, and since an R portion is formed on each of the end portions of the casing 6, the doughnut-shaped member 21 can be naturally covered on the casing 6 and finally attracted to be fixed by the ring-shaped magnet 22.

The following description will discuss the using state of the fastening tool. The doughnut-shaped member 21 of the fastening member b is attracted and fixed onto the ring-shaped magnet 22 so as to allow the doughnut-shaped member 21 to cover the casing 6 of the fastening member a. Since the ring-shaped magnet 22 is installed on the outside of the casing 6, the casing 6 protrudes onto one direction side of the ring-shaped magnet 22, with the casing 6 being inserted inside of the doughnut-shaped member 21 in its attracted and fixed state. Thus, since the fastening members a and b are mutually attracted and fixed at a correct position, it is possible to prevent the opening portion from being undesirably opened, and also to prevent the doughnut-shaped member 21 and the ring-shaped magnet 22 in the attracted and fixed state from being deviated in the surface direction.

Moreover, since the substrate 1 of one of the fastening members a is formed into a plate-like shape, it is possible to reduce the occurrence of such a problem in that it is undesirably caught by an object, a finger, or the like, in comparison with the case in which the pierce catch 3 protrudes outward. Furthermore, an accessory member 23, such as jewelry or the like, can be easily attached to the substrate 1. Additionally, in the present embodiment, the pierce catch 3, which is of the type shown in the embodiment 4, has been used; however, any of the types shown in the embodiments 1 to 3 may be used. Moreover, the doughnut-shaped member 21 may be formed by using a magnet. Furthermore, when the doughnut-shaped member 21 is made of a magnet, the ring-shaped magnet 22 is made of a magnetic material.

Embodiment 6

Figure 11:
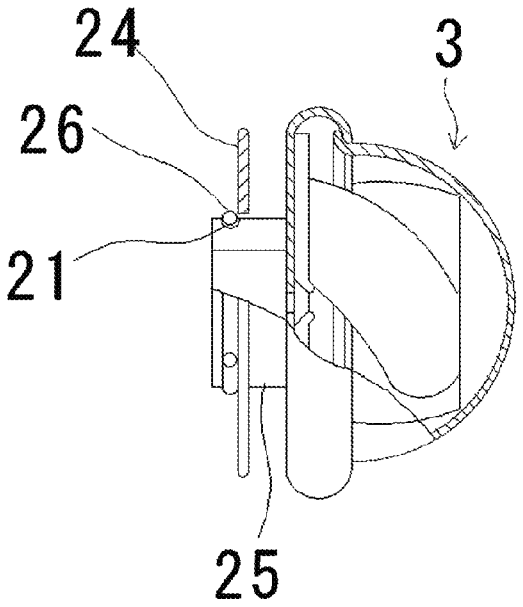
FIG. 11 is a partially exploded side view showing a pierce catch in which the structure of a pierce catch 3 relating to the embodiments 1 to 3 is altered.
Figure 12:
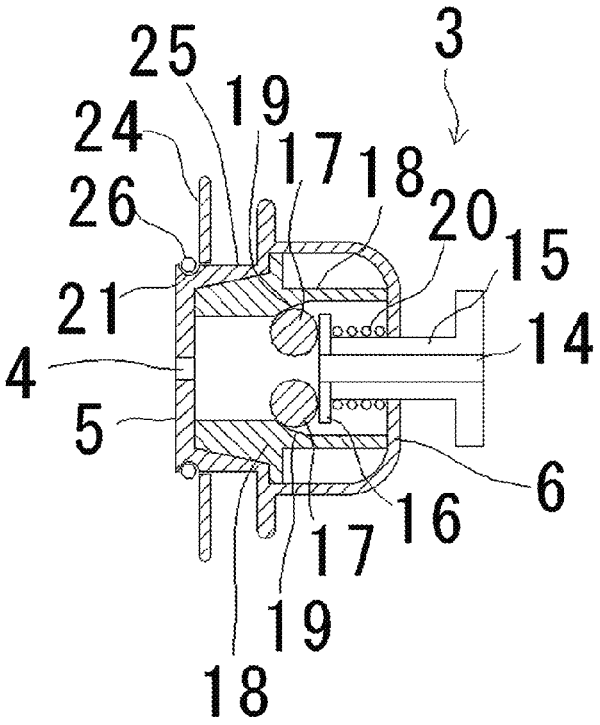
FIG. 12 is a cross-sectional view showing a pierce catch in which the structure of the pierce catch relating to the embodiments 4 and 5 is altered.

FIG. 11 is a partially exploded side view showing a pierce catch whose structure is modified from the structure of the pierce catches 3 relating to the embodiments 1 to 3. FIG. 12 is a cross-sectional view showing a pierce catch whose structure is altered from the pierce catch relating to the embodiments 4 and 5.

In the pierce catch 3 shown in FIG. 11, a cylinder member 25 is formed on the lower portion of the bottom surface member 5, and a snap pin groove 21 is formed in the vicinity of the end portion of the peripheral wall. A stop ring 24 having a disc shape with an opening formed in the center is attached onto the cylinder member 25. A snap pin 26, formed by bending and shaping a rod-shaped metal into a C-letter shape, is fitted to the snap pin groove 21 when expanded. By this snap pin 26, the stop ring 24 is prevented from coming off the cylinder member 25. Between the stop ring 24 and the casing 6, a gap for use in holding an accessory member 23 in a fitted state therein is formed.

In the pierce catch 3 shown in FIG. 12, a flange portion is formed on an outer wall intermediate surface of the casing 6 so as to be expanded sideward, and a cylinder portion 25 is formed on the lower portion thereof. A snap pin groove 21 is formed in the vicinity of the end portion of the cylinder portion 25. A snap pin 26, formed by bending and shaping a rod-shaped metal into a C-letter shape, is fitted to the snap pin groove 21 when expanded. By this snap pin 26, the stop ring 24 is prevented from coming off the cylinder portion. Between the stop ring 24 and the flange portion, a gap for use in holding an accessory member 23 in a fitted state therein is formed.

Figure 13:
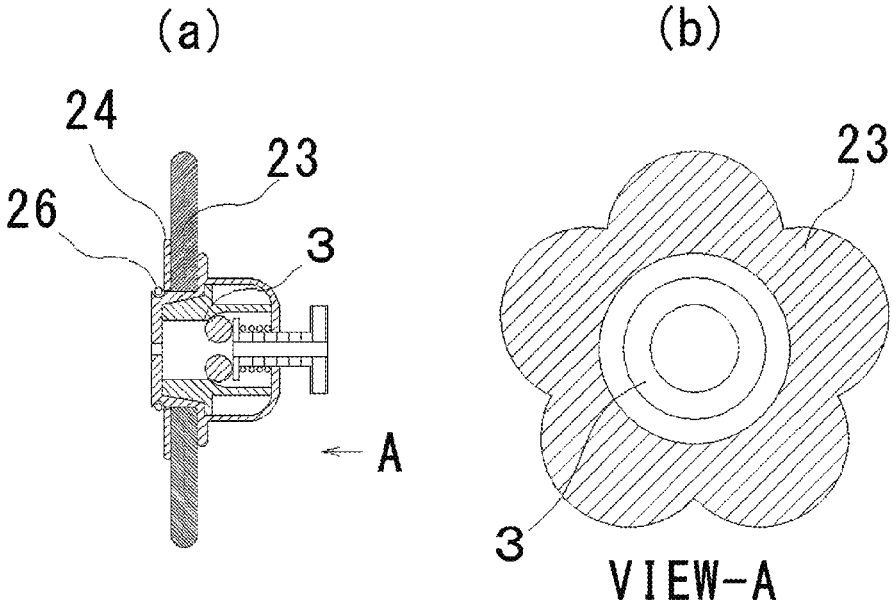
FIG. 13 is an explanatory view showing a state in which an accessory is attached to a fastening tool shown in FIG. 12.

FIG. 13 is an explanatory view showing a state in which an accessory is attached to the fastening tool shown in FIG. 12. In an example of this Figure, an accessory 23 made of a flat plate having a flower shape is shown. The plate thickness of the accessory 23 is supposed to be smaller than the gap between the flange and the stop ring. By removing the snap pin 26, the stop ring is drawn from the cylinder portion. Then, the accessory 23 with an opening formed in the center is inserted. The cylinder portion is inserted to the opening formed in the center of the accessory 23. Moreover, the stop ring 24 is attached to the cylinder portion, and the snap pin is fitted to the snap pin groove 21 so that the accessory 23 is fixed by the stop ring 26 and the flange. Additionally, the accessory 23 may have any shape as long as it can be inserted to the cylinder member or the cylinder portion.

Additionally, in the fastening tool shown in FIG. 11 also, the accessory 23 may be attached thereto in the same sequence of processes as those described above (not shown). First, by removing the snap pin 26, the stop ring 24 is drawn from the cylinder member 25, and the accessory 23 with an opening formed in the center is inserted thereto. Then, the cylinder member 25 is inserted into the opening formed in the center of this flower shape, and the stop ring 24 is attached to the cylinder member 25. Lastly, the snap pin 26 is fitted to the snap pin groove 21 so that the accessory 23 is fixed by the stop ring 26 and the bottom surface member.

In accordance with this structure, the accessory 23 can be easily attached to the pierce catch 3. Moreover, many accessories 23 may be attached thereto as long as they are provided with holes through which the cylinder member 25 can be inserted.

Embodiment 7

Figure 14:
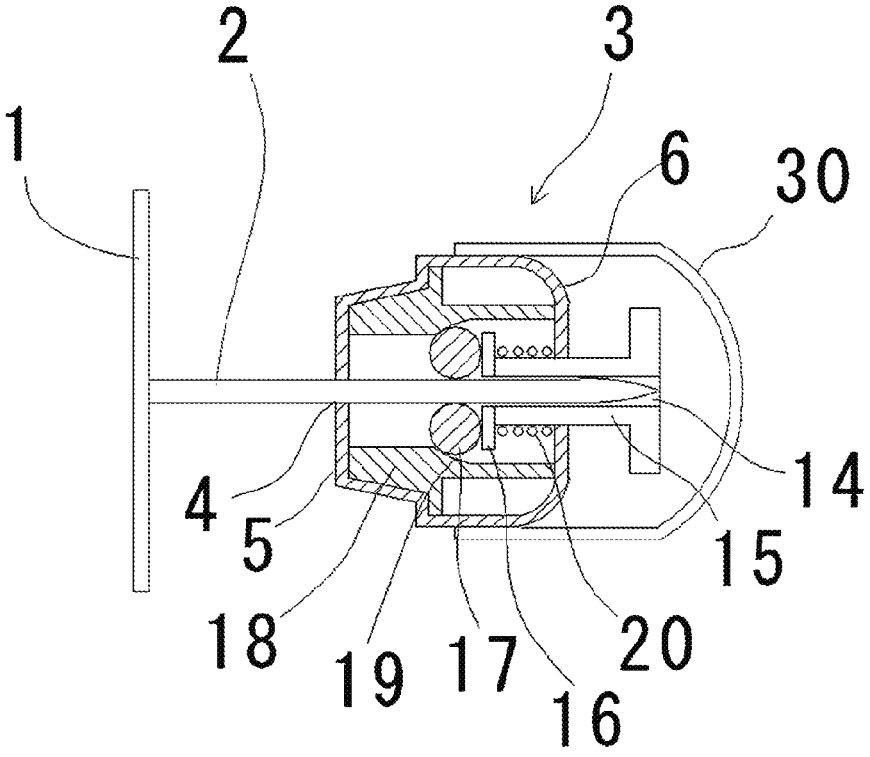
FIG. 14 is a cross-sectional view showing a pierce catch in accordance with an embodiment 7.

FIG. 14 is a cross-sectional view showing a pierce catch in accordance with an embodiment 7. This pierce catch is characterized in that the pierce catch of the fastening tool shown in the embodiments 4 to 6 is provided with a cap 30 for use in preventing an erroneous operation. A screw is formed on the outer side face of the casing of the pierce catch. A thread corresponding to the screw of the casing is formed in the vicinity of the inside end portion of the cap 30, and the cap 30 can be attached to the casing in a manner so as to cover the grip member serving as the detachably attaching portion for the piercing needle 2. The entire shape of the cap 30 may be formed into a semispherical shape or a butterfly shape that can be easily grabbed. Thus, it is possible to prevent an accidental contact with the grip portion, with the result that the piercing needle is subsequently released. Additionally, since the cap 30 is formed to prevent the accidental contact with the grip portion, one portion thereof may be opened as long as it can surround the periphery of the grip member.

Embodiment 8

Figure 15:
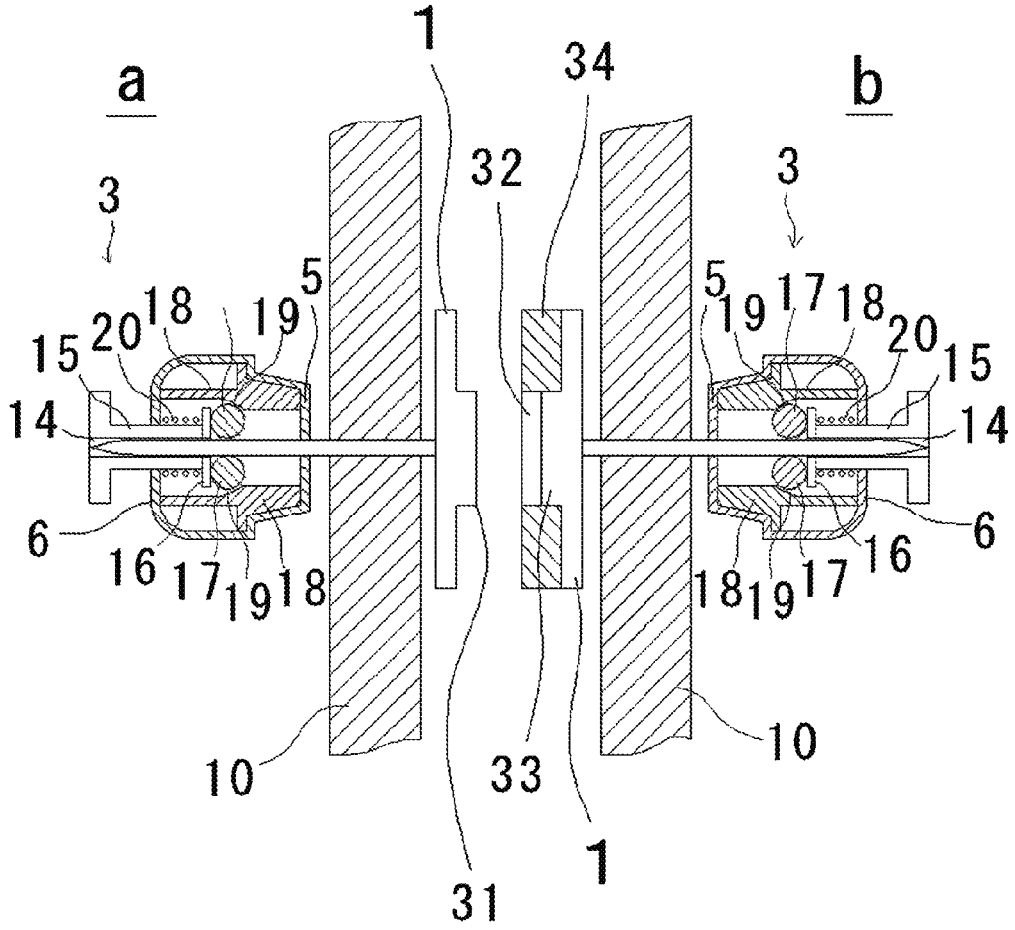
FIG. 15 is a cross-sectional view showing a fastening tool in accordance with an embodiment 8.

FIG. 15 is a cross-sectional view showing a fastening tool in accordance with an embodiment 8. In this fastening tool, a convex portion 31 is formed on the surface of the substrate 1 of the fastening member a, and a concave portion 32 is formed on the surface of the substrate 1 of the fastening member b. The concave portion is constituted by a protruding portion formed on the substrate 1 and a doughnut-shaped magnet that is thicker than the protruding portion, and fitted to the periphery of the protruding portion. Upon attracting the substrates 1 to be fixed to each other, the convex portion 31 is fitted to the concave portion 32. Additionally, the pierce catch 3 has the same structure as those shown in the embodiments 4 to 7; however, those shown in the embodiments 1 to 3 may also be used (not shown).

Embodiment 9

Figure 16:
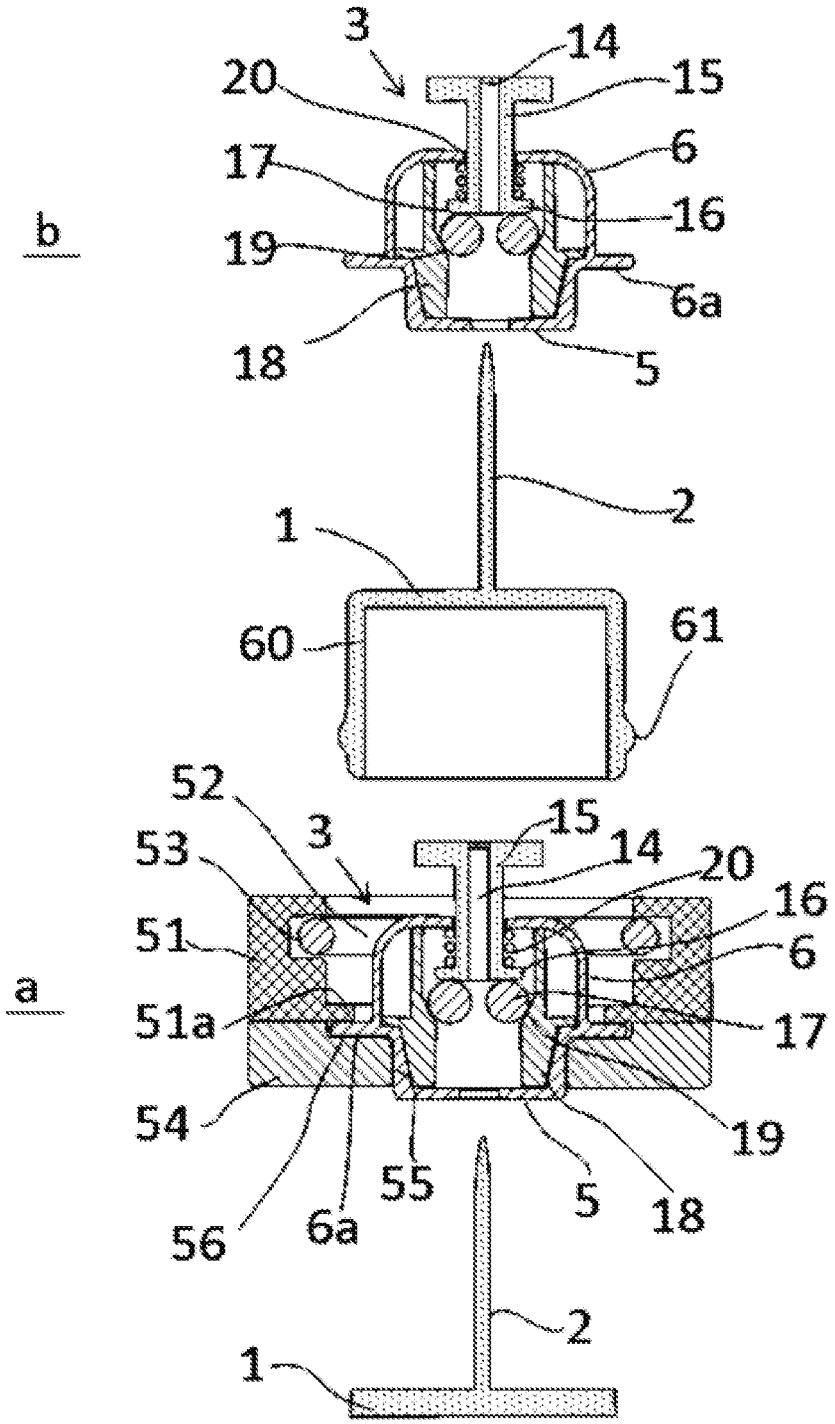
FIG. 16 is a cross-sectional view showing a fastening tool in accordance with an embodiment 9.
Figure 17:
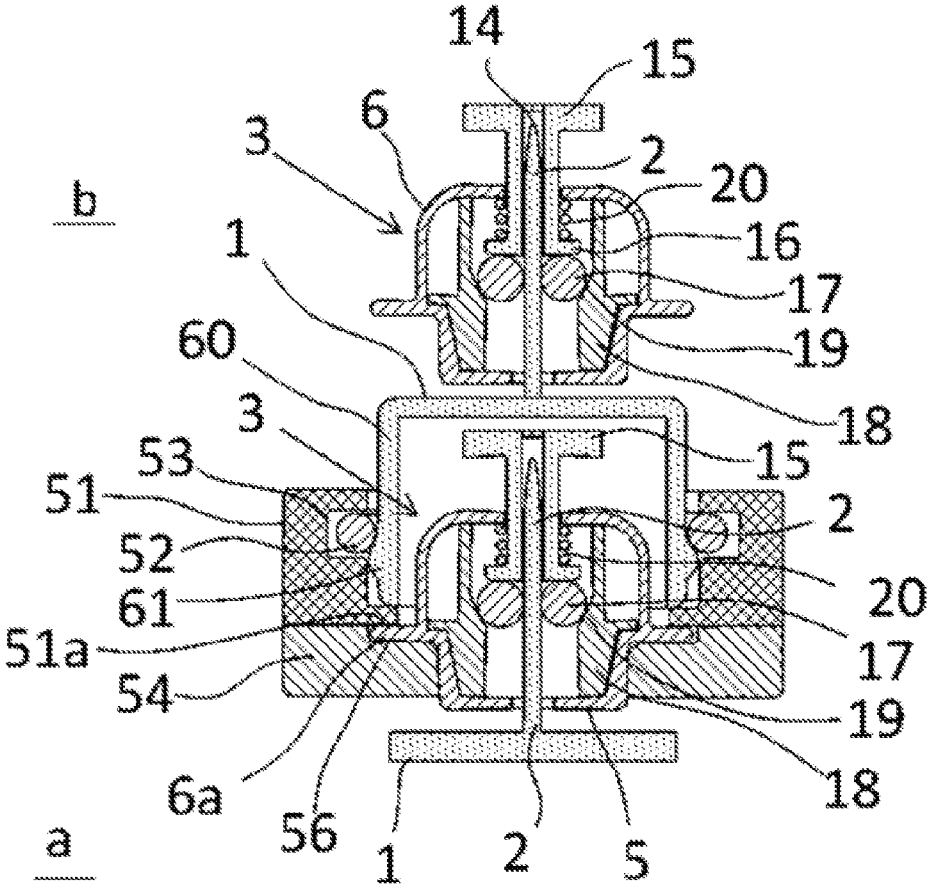
FIG. 17 is an explanatory view showing a using state of the fastening tool shown in FIG. 16.

FIG. 16 is a cross-sectional view showing a fastening tool in accordance with an embodiment 9. FIG. 17 is an explanatory view showing the using state of the fastening tool shown in FIG. 16. This fastening tool is constituted by a pair of fastening members a and b. Each of the fastening members a and b is provided with a substrate 1 with a piercing needle 2 formed on its rear surface and a pierce catch 3 that holds the piercing needle 2. This pierce catch 3 is the same as the pierce catch 3 shown in the embodiment 4; therefore, the explanation thereof will be omitted, and the same components are indicated by the same reference numerals.

In the fastening member a, a collar portion 6*a* is formed in the substantially center position of the peripheral portion in the axial direction (in the vertical direction in the Figure, in the length direction of the through hole 14) of casing 6 of the pierce catch 3. A ring member 51 is attached to the collar portion 6*a* on the fastening member b side. One portion of the end face of the ring member 51 is made in contact with the collar portion 6*a*. A snap pin groove 53 for holding the snap pin 52 is formed on the inner surface of the ring member 51. The snap pin 52, formed by bending and shaping a rod shaped metal into a C-letter shape, is fitted to the snap pin groove 53 when expanded. On the color portion 6*a* side of the ring member 51, an inner collar portion 51*a* is formed toward the inside, and is made in contact with the collar portion 6*a* of the casing 6. The inner collar portion 51*a* is made in contact with the end surface of a tube-shaped member 60, which will be described later, of the fastening member b so as to regulate the position.

The outer surface of the ring member 51 has a simple cylindrical curved surface in the Figure; however, it may be formed into a shape whose design performance is enhanced. Moreover, a fixed plate 54 is formed on the ring member 51. The fixed plate 54 has a disc shape in which a hole 55 to which the casing 6 is fitted is formed in the center, with a shallow ring-shaped concave portion 56 for holding the collar portion 6*a* of the casing being further formed on the periphery of the hole 55. Furthermore, the end face of the fixed plate 54 is made in contact with the end face of the ring member 51, and joined thereto by bonding or welding. By attaching the fixed plate 54 to the ring member 51, the collar portion 6*a* of the casing 6 is fitted to the ring-shaped concave portion 56, and sandwiched by an inner collar portion 51*a* of the ring member 51 so that the casing 6 is held and fixed by the ring member 51 and the fixed plate 54. In this state, the insertion opening 4 of the casing 6 is exposed from the fixed plate 54, and the grip member 15 is brought to an exposed state inside the ring member 51. The snap pin 52 is located in the vicinity of the ceiling of the casing 6.

On the other hand, on the substrate 1 of the fastening member b, a tube-shaped member 60 is formed on the side opposite to the piercing needle 2. The tube-shaped member 60 may be integrally molded with the substrate 1. In this case, the length in the axial direction (vertical direction in the Figure, length direction of the piercing needle 2) of the tube-shaped member 60 and the diameter thereof are set to such levels as to sufficiently house the casing 6 of the fastening member a and the grip member 15. Moreover, the outer diameter of the tube-shaped member 60 is slightly smaller than the inner diameter of the ring member 51. Furthermore, the thickness of the tube-shaped member 60 is set in such a range so as to be inserted to a gap between the inner surface of the ring member 51 of the fastening member a and the outer surface of the casing 6. On the periphery of the tube-shaped member 60, a protruding portion 61 to be engaged with the snap pin 52 is formed. The protruding portion 61 has a semi-circular shape, and is designed to be smoothly made in contact with the snap pin 52 so as to easily push and expand the snap pin 52. The respective dimensions are determined so that in a state where the protruding portion 61 is engaged with the snap pin 52, the edge of the tube-shaped member 60 is made in contact with the inner collar portion 51*a* of the ring member 51.

As shown in FIG. 17, when used, the fastening member a and the fastening member b are respectively attached to the opening portion of a handbag, or the like (not shown). The operations of the pierce catch 3 are the same as those of the aforementioned embodiment 4. Upon closing the opening portion by the fastening members a and b, the tube-shaped member 60 of the fastening member b is inserted the inside of the ring member 51 of the fastening member a, and also pushed therein so as to cover the casing 6. The protruding portion 61 of the tube-shaped member 60 pushes the snap pin 52 to be expanded, and gets over this so that the end portion thereof is made in contact with the inner collar portion 51*a*. In this state, the tube-shaped member 60 is held inside the ring member 51 by the inner collar portion 51*a* and the snap pin 52.

Moreover, the casing 6 is inserted the inside of the tube-shaped member 60. Thus, the external appearance of the fastening tool is covered with the ring member 51 and the tube-shaped member 60, with the inner structure being concealed, so that it looks compact and is kept in a beautiful state. Furthermore, the compact external appearance has no catching portions; therefore, even when it protrudes inside a handbag or the like, no objects are caught therewith.

In this case, by forming the substrate 1 of one of the fastening member a into a plate-like shape, a problem in which an article, a finger or the like is caught by the fastening member hardly occurs in comparison with the case in which the pierce catch 3 protrudes outward. Moreover, an accessory member such as jewelry can be easily attached to the substrate 1. Additionally, in the present embodiment, the pierce catch 3, which is of the type shown in the embodiment 4, has been used; however, any of the types shown in the embodiments 1 to 3 may be used.

In accordance with this fastening tool, as long as the material is cloth or leather, the corresponding attaching process can be carried out at any place without requiring any big working process. Moreover, since the removing process can be freely carried out, the same material can be used many times. Furthermore, since the attaching process is carried out by the piercing needle, hardly any trace remains on the cloth. By attaching the fastening tool to an existing product, simple cloth can be formed into a muffler, scarf, cloak, or the like, which is fastened before the neck. Since it is easily attached to any position, for example, a tote bag is designed to be openable and closable at any desired position to be closed. Furthermore, by using a plurality of fastening tools, a plurality of binding positions may be set.

Embodiment 10

Figure 18:
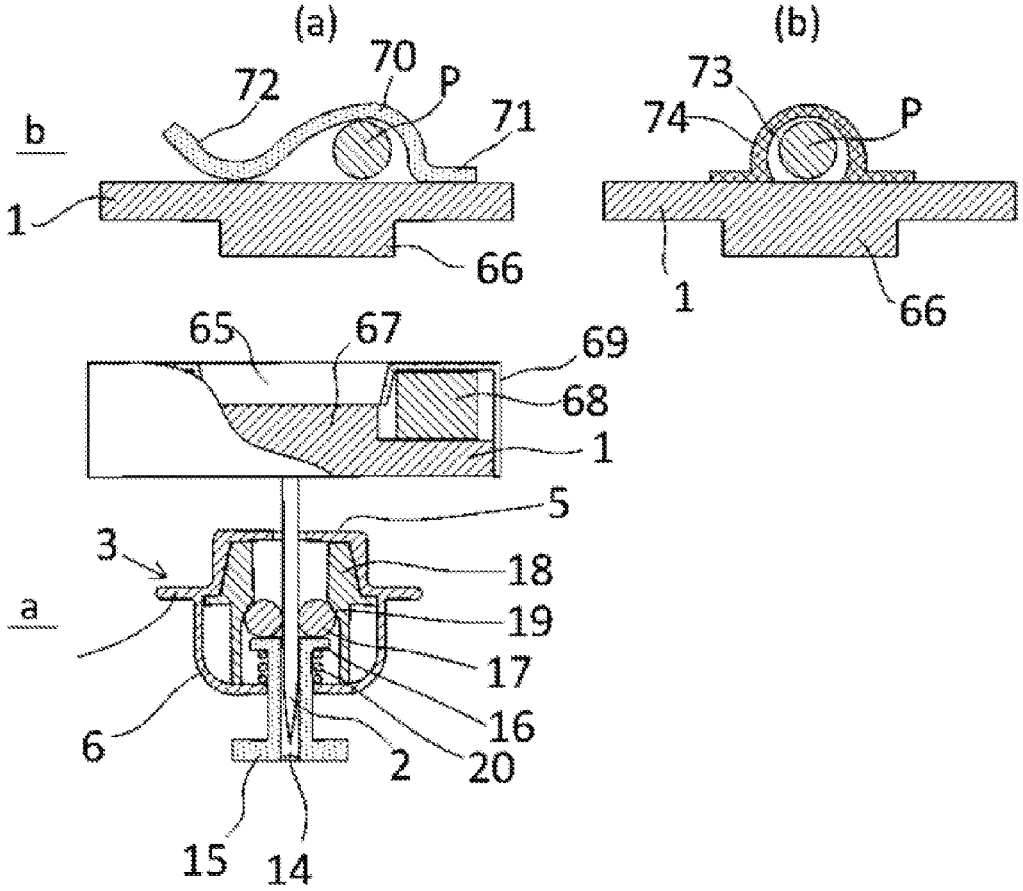
FIG. 18 is a cross-sectional view showing a fastening tool in accordance with an embodiment 10.
Figure 19:
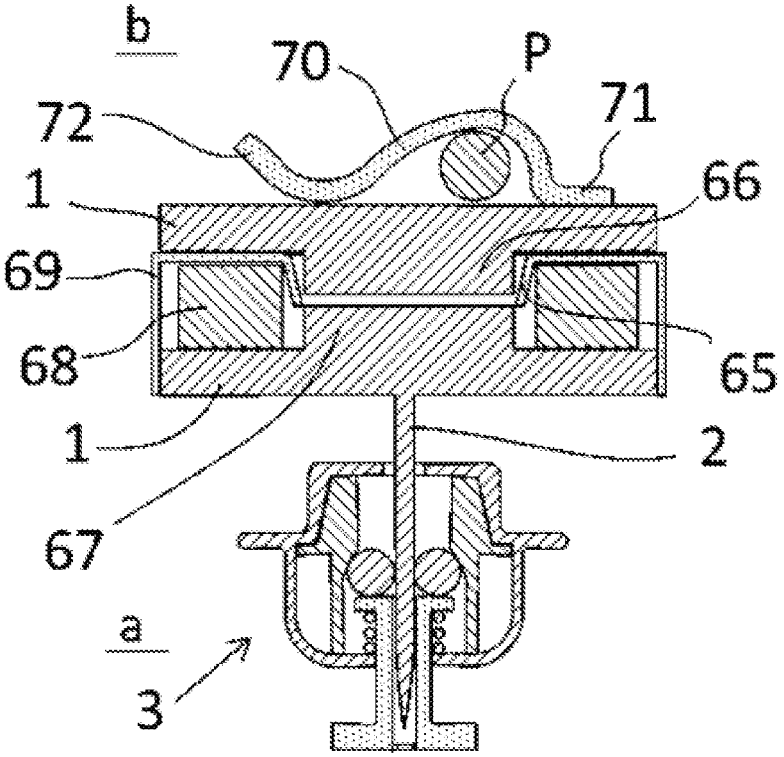
FIG. 19 is an explanatory view showing a using state of the fastening tool shown in FIG. 18.

FIG. 18 is a cross-sectional view showing a fastening tool in accordance with an embodiment 10. FIG. 19 and FIG.

29(*a*) are explanatory views showing a using state of the fastening tool shown in FIG. 18. In this fastening tool, a concave portion 65 is formed on the surface of the fastening member a of the substrate 1, and a convex portion 66 is formed on the surface of the fastening member b of the substrate 1.

On the substrate 1 of the fastening member a, a protruding portion 67 having a round shape when seen in a plan view is formed in the center. On the periphery of this, a doughnut-shaped magnet 68 that is thicker than the protruding portion 67 is formed. The substrate 1 and the magnet 68 are covered with a cover 69. The cover 69, which is made of a thin material, is formed from the periphery of the substrate 1 to the periphery of the magnet 68 as well as to the end face on the fastening member b side of the magnet 68, and is further formed diagonally from the inside end portion of the magnet 68 toward the inside thereof. The end portion of the cover 69 is connected to a corner of the protruding portion 67 of the substrate 1. Thus, the concave portion 65 can be formed in the vicinity of the center portion of the entire fastening member a.

On a surface opposite to the surface on which the convex portion 66 of the fastening member b is formed, as shown in (a) of the Figure, a hook member 70 is formed. The hook member 70 is a molded member made of metal, and one end 71 thereof is welded onto the substrate 1, and the center portion is separated from the surface of the substrate 1 to be curved outward, and again made in contact with the surface of the substrate 1, with the other end being formed into a warped shape. Thus, a wire of a safety pin P is inserted from the other end 72 of the warped shape so as to be inserted into the hook member 70. In (b) of the Figure, an example in which an insertion hole is formed in place of the hook member 70 is shown. The insertion hole 73 is formed by welding the two ends of a semi-tubed member 74 onto the substrate 1. The wire of the safety pin P is inserted into the insertion hole 73.

Figure 29:
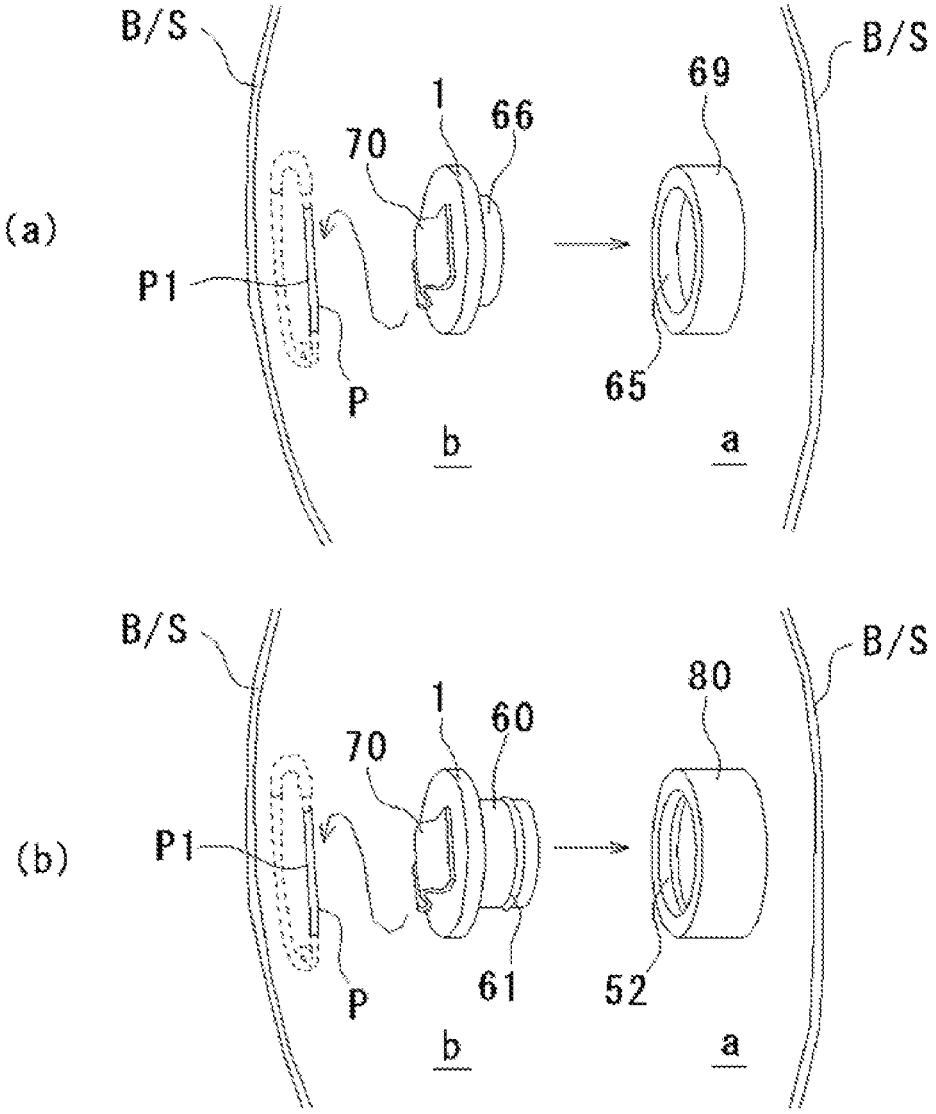
FIG. 29 is an explanatory view showing a using method of the embodiments 10 to 12.

As shown in FIG. 29(*a*), this fastening tool allows the fastening member b to be engaged with on the safety pin P attached to one portion of a bag B or a muffler S. The safety pin P is attached to, for example, one portion of the opening portion of a handbag, and at this time, onto a wire P1 protruding on the rear surface, the hook member 70 is pushed so that the fastening member b is locked. By piercing the piercing needle 2 at a position corresponding to the one portion of the handbag, with the pierce catch 3 being attached thereto from the rear surface, the fastening member a is fixed to the corresponding position. Successively, the concave portion 65 of the fastening member a is fitted to the convex portion 66 of the fastening member b so that the substrates 1 are mutually attracted and fixed to each other by the magnetic force of the magnet 68. Thus, the opening portion of the handbag is made openable and closable.

In accordance with this fastening tool, as long as the material is cloth or leather, the corresponding attaching process can be carried out at any place without requiring any big working process. In particular, since the attaching process is carried out by using the safety pin P, its versatility is further increased. Moreover, since the removing process can be freely carried out, the same material can be used many times. Furthermore, since the attaching process is carried out by the piercing needle 2 and safety pin P, hardly any trace remains on the cloth. By attaching the fastening tool to an existing product, simple cloth can be formed into a muffler, scarf, cloak, or the like, which is fastened before the neck. Since it is easily attached to any position, for example, a tote bag is designed to be openable and closable at any desired position to be closed. Furthermore, by using a plurality of fastening tools, a plurality of binding positions may be set. By using a safety pin with an accessory, it is possible to form an openable/closable fastening tool with the accessory.

Embodiment 11

Figure 20:
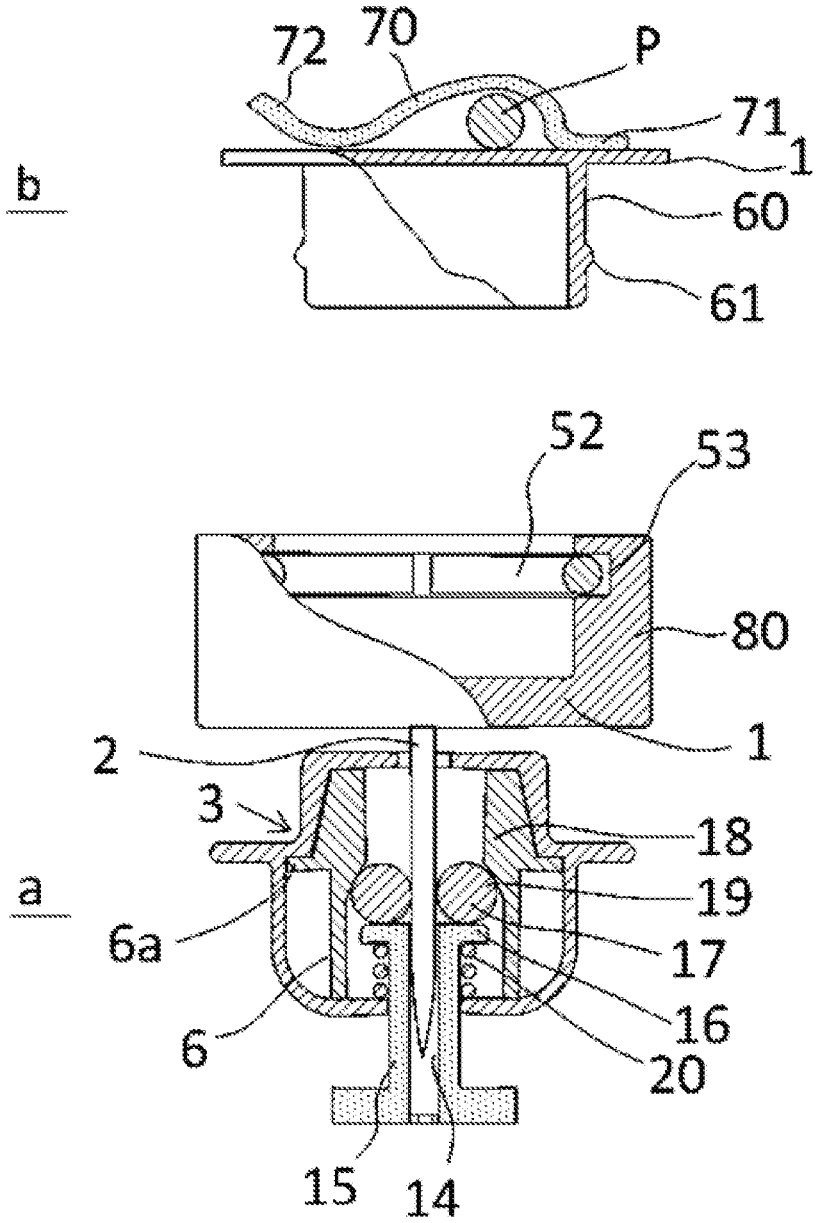
FIG. 20 is a cross-sectional view showing a fastening tool in accordance with an embodiment 11.
Figure 21:
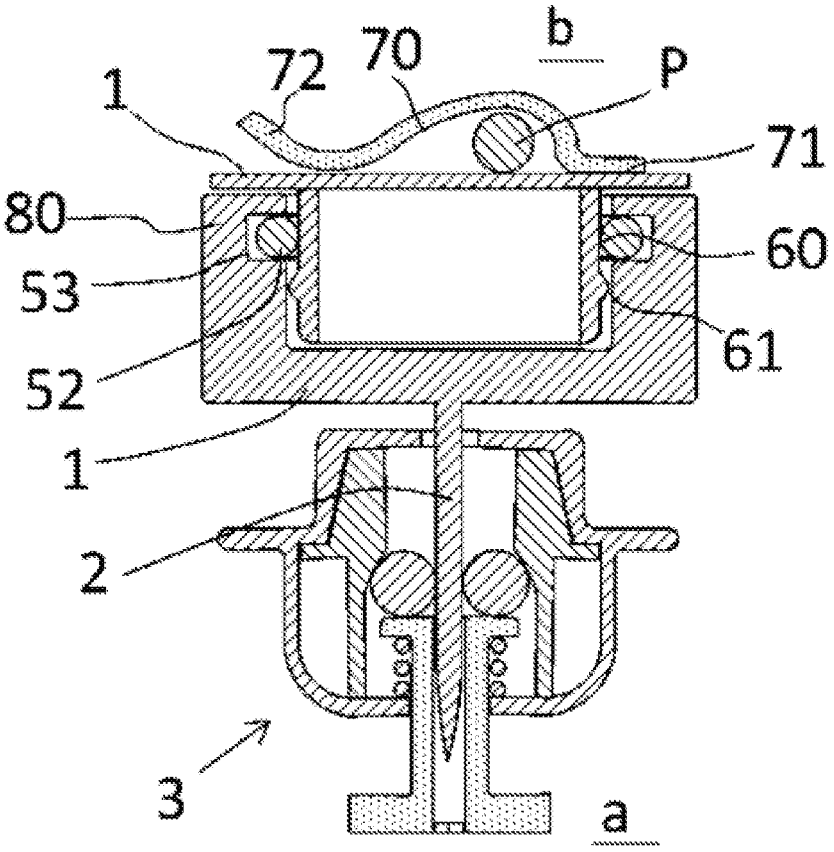
FIG. 21 is an explanatory view showing a using state of the fastening tool shown in FIG. 20.

FIG. 20 is a cross-sectional view showing a fastening tool in accordance with an embodiment 11. FIG. 21 and FIG. 29(*b*) are explanatory views showing a using state of the fastening tool shown in FIG. 20. In the fastening member a of this fastening tool, a ring member 80 is formed on the substrate 1. On the inner surface of the ring member 80, a snap pin groove 53 for holding a snap pin 52 is formed. The snap pin 52, which is formed by bending and shaping a rod shaped metal into a C-letter shape, is fitted to the snap pin groove 53 when expanded. The outer surface of the ring member 80 has a simple cylindrical curved surface in the Figure; however, it may be formed into a shape whose design performance is enhanced.

On the other hand, on the substrate 1 of the fastening member b, a tube-shaped member 60 is formed. The tube-shaped member 60 may be integrally molded together with the substrate 1. In this case, the length in the axial direction (vertical direction in the Figure) of the tube-shaped member 60 is substantially the same as the length in the axial direction (vertical direction in the Figure) of the ring member 80. Moreover, the outer diameter of the tube-shaped member 60 is slightly smaller than the inner diameter of the ring member 80. On the periphery of the tube-shaped member 60, a protruding portion 61 to be engaged with the snap pin 52 is formed. The protruding portion 61 has a substantially semi-circular shape, and is designed to be smoothly made in contact with the snap pin 52 so as to easily push and expand the snap pin 52. The respective dimensions are determined so that in a state where the protruding portion 61 is engaged with the snap pin 52, the edge of the tube-shaped member 60 is made in contact with the surface of the substrate 1 of the fastening member a.

As shown in FIG. 21 and FIG. 29(*b*), when used, for example, the fastening member a is attached to the opening portion of a handbag B (not shown). The operations of the pierce catch 3 are the same as those of the embodiment 4. Moreover, the fastening member b is engaged with the safety pin P. The safety pin P is attached to the corresponding position of the opening portion of the handbag, and at this time, onto a wire P1 protruding on the rear surface, the hook member 70 is pushed so that the fastening member b is locked. When the opening portion is closed by the fastening members a and b, the tube-shaped member 60 of the fastening member b is pushed and inserted inside the ring member 80 of the fastening member a. The protruding portion 61 of the tube-shaped member 60 pushes the snap pin 52 to be expanded, and gets over this so that the end portion thereof is made in contact with the substrate 1. In this state, the tube-shaped member 60 is held inside the ring member 80 by the snap pin 52.

As shown in FIG. 21, the external appearance of the fastening tool looks compact and beautiful, with the ring member 80 and the tube-shaped member 60 being exactly fitted to each other. Furthermore, the compact external appearance has no catching portions; therefore, even when it protrudes inside a handbag or the like, no objects are caught therewith. Additionally, in the present embodiment, the pierce catch 3, which is of the type shown in the embodiment 4, has been used; however, pierce catches 3 of any of the types shown in the embodiments 1 to 3 may be used.

In accordance with this fastening tool, as long as the material is cloth or leather, the corresponding attaching process can be carried out at any place without requiring any big working process. Moreover, since the removing process can be freely carried out, the same material can be used many times. Furthermore, since the attaching process is carried out by the piercing needle 2 and the safety pin P, hardly any trace remains on the cloth. By attaching the fastening tool to an existing product, simple cloth can be formed into a muffler, scarf, cloak, or the like, which is fastened before the neck. Since it is easily attached to any position, for example, a tote bag is designed to be openable and closable at any desired position to be closed. Furthermore, by using a plurality of fastening tools, a plurality of binding positions may be set. Furthermore, by using the safety pin with an accessory, it is possible to form an opening/closing fastening tool with the accessory.

Embodiment 12

Figure 22:
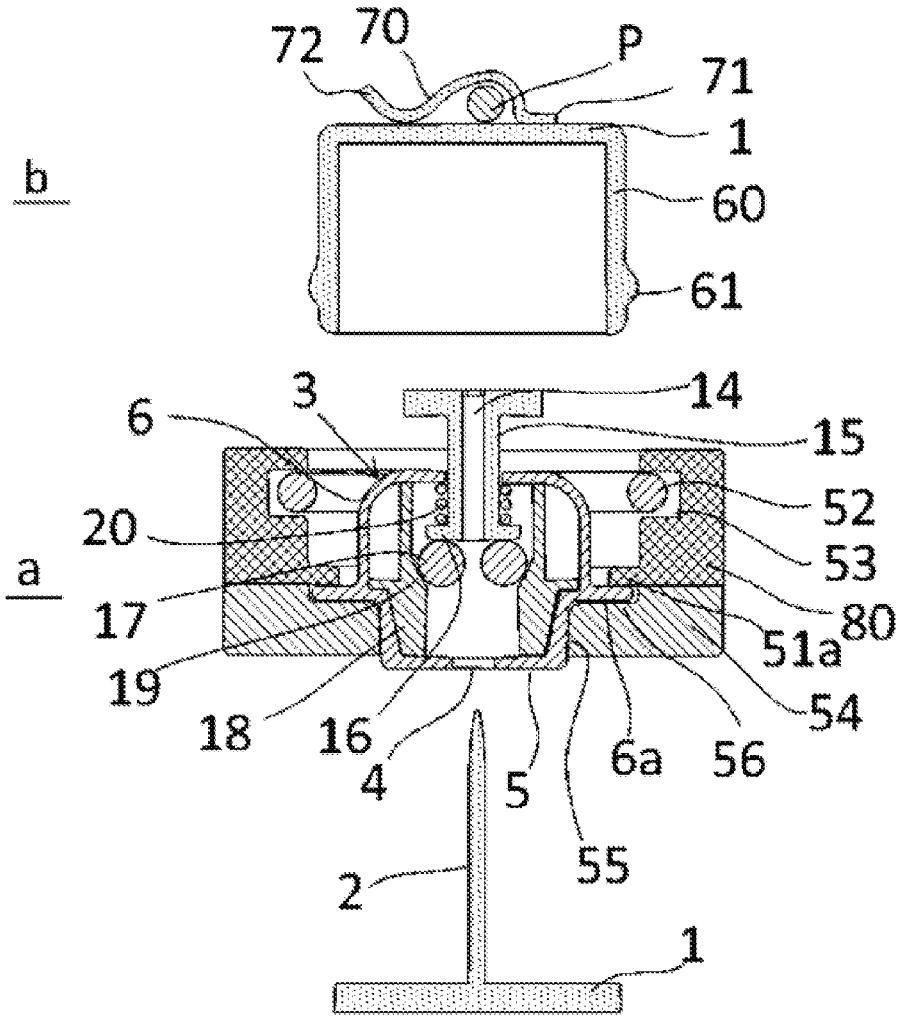
FIG. 22 is a cross-sectional view showing a fastening tool in accordance with an embodiment 12.
Figure 23:
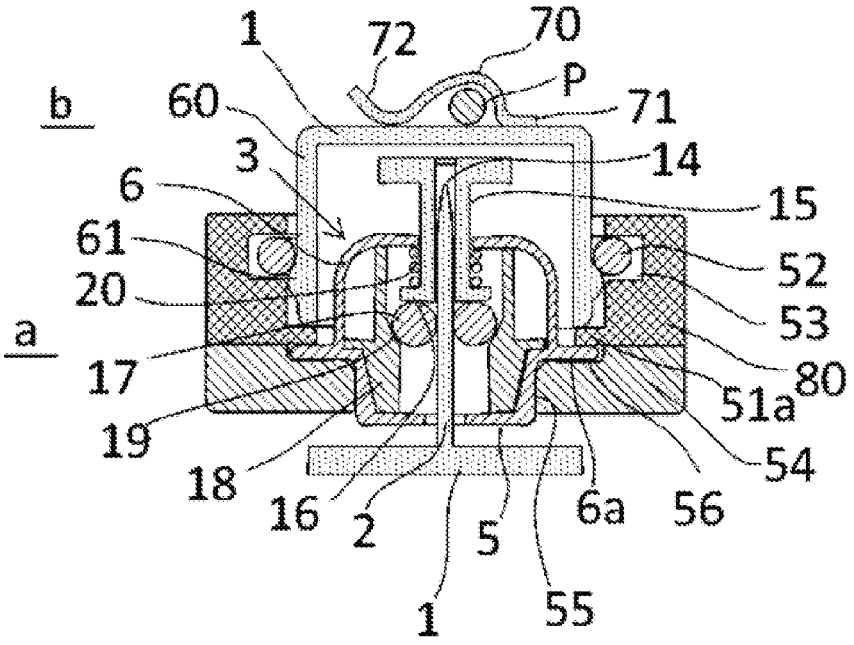
FIG. 23 is an explanatory view showing a using state of the fastening tool shown in FIG. 22.

FIG. 22 is a cross-sectional view showing a fastening tool in accordance with an embodiment 12. FIG. 23 is an explanatory view showing a using state of the fastening tool shown in FIG. 22. As shown in the Figure, a tube-shaped member 60 may be formed on the peripheral edge of the substrate 1 of the fastening member b. The other components have the same structures as those of the fastening member b shown in the embodiment 11; therefore, the same components are indicated by the same reference numerals. Moreover, on the periphery of the tube-shaped member 60, a protruding portion 61 to be engaged with the snap pin 52 is formed.

Since the fastening member a has the same structure as the fastening member b shown in the embodiment 9, the same components are indicated by the same reference numerals.

As shown in FIG. 23, the external appearance of the fastening tool looks compact and more beautiful, with the ring member and the tube-shaped member 60 being exactly fitted to each other. Moreover, no flange structures are formed on the substrate 1, and a compact external appearance with no catching portions is provided; therefore, even when it protrudes inside a handbag or the like, no objects are caught therewith. Additionally, in the present embodiment, the pierce catch 3, which is of the type shown in the embodiment 4, has been used; however, pierce catches 3 of any of the types shown in the embodiments 1 to 3 may be used.

As indicated by the embodiments 1 to 12, the fastening tool of the present invention is configured such that without the necessity of any processing jobs, such as caulking, sewing and the like, of buttons, metal fittings, etc., on the opening portion of clothing, baggage or the like, after the piercing needle 2 has penetrated at a desired portion on the two sides of the opening portion, it can be fixed by using an attached pierce catch; therefore, a detachably attaching process can be easily carried out. Moreover, since the tip of the piercing needle 2 is enclosed by the pierce catch 3, it can be safely used without causing a stab wound or the like at the time of handling. Furthermore, it is freely detachably attached and portable; therefore, in the case when a wrapping cloth or the like in hand is folded to be used as a make-shift bag, it is used as a fastening tool for locking the opening portion so that this fastening tool has a high quick response property. This property is exerted in the same manner in the case of the safety-pin P type.

(Example of Using Mode)

Figure 24:
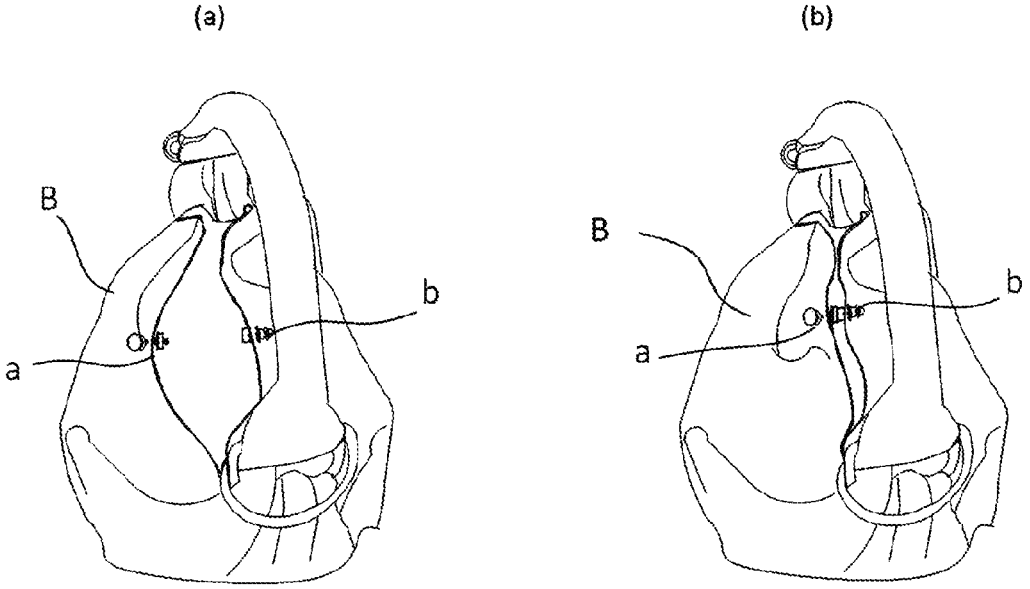
FIG. 24 is an explanatory view showing using modes of fastening tools shown in the above-mentioned embodiments 1 to 12.

FIG. 24 is an explanatory view showing a using mode of the fastening tool shown in the above-mentioned embodiments 1 to 11. In this fastening tool, by fixing a wrapping cloth to double rings attached to the two sides of a handle, a handbag B is formed. As shown in FIG. 24(*a*), fastening members a and b are attached to the opening portion of the handbag B. The attaching method is the same as shown in the above-mentioned embodiments 1 to 11. Next, as shown in FIG. 24(*b*), the opening portion is closed by fastening the fastening members a and b to each other.

Figure 25:
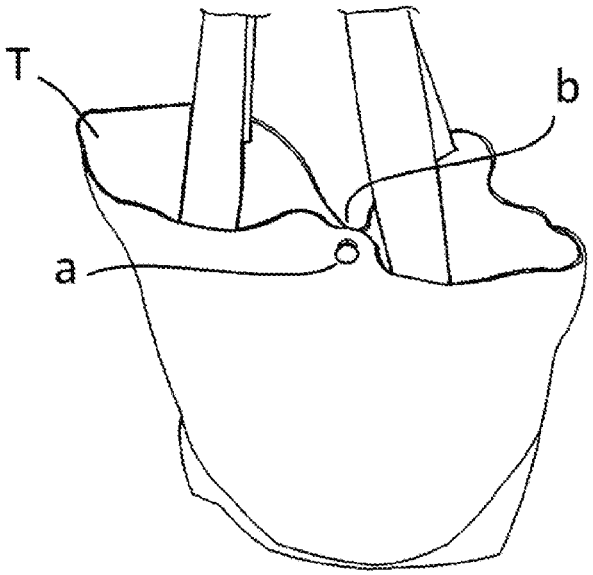
FIG. 25 is an explanatory view showing an example in which a fastening tool is applied to a tote bag.

FIG. 25 is an explanatory view showing an example in which the fastening tool is applied to a tote bag. In the same manner, the fastening members a and b are attached to the opening portion of the tote bag T, and the opening portion is closed by fastening the fastening members a and b to each other.

Figure 26:
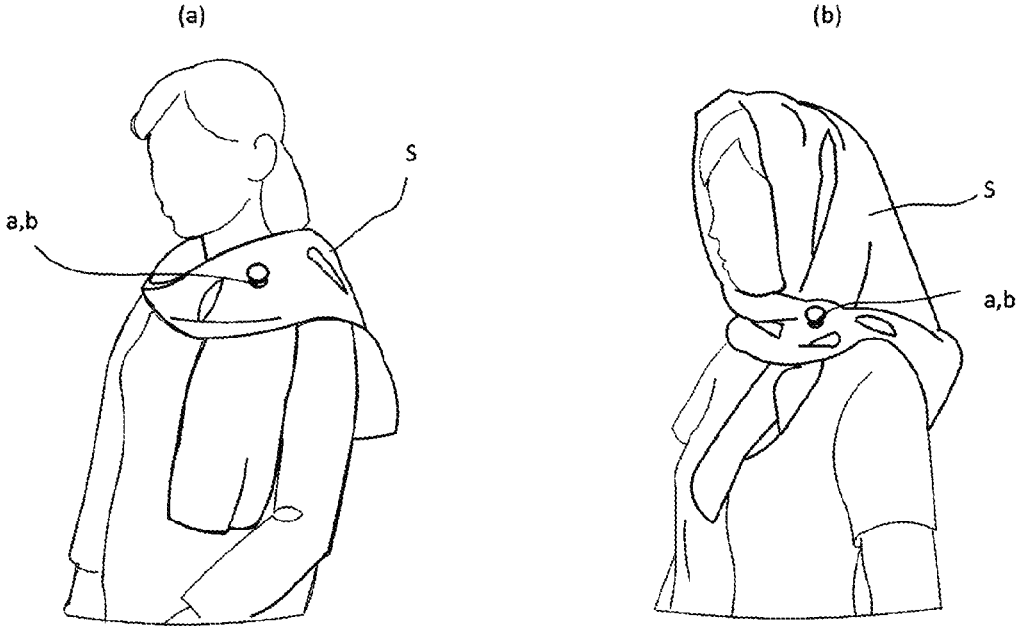
FIG. 26 is an explanatory view showing an example in which a fastening tool is applied to a muffler or a stole.

FIG. 26 is an explanatory view showing an example in which the fastening tool is applied to a muffler or stole. For example, as shown in FIG. 26(*a*), the fastening members a and b are attached to each of two portions of the muffler S, and the fastening members a and b are fastened to each other, with the muffler S being wound around the neck. Thus, the muffler S can be easily fixed around the neck. Moreover, as shown in FIG. 26(*b*), the fastening members a and b are attached to each of the two portions of the stole S, and the fastening members a and b are fastened to each other, with the stole S being put over the head. Thus, the stole S can be easily put over the head.

Figure 27:
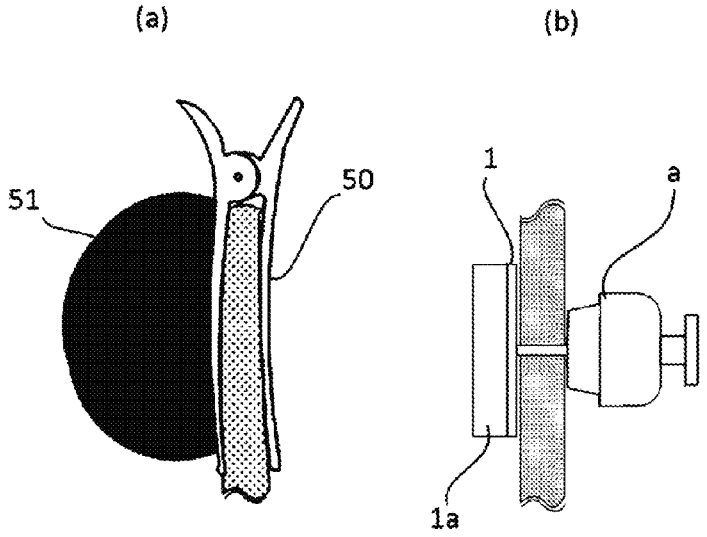
FIG. 27 is an explanatory view showing an example in which only one fastening member of a fastening tool is used.
Figure 28:
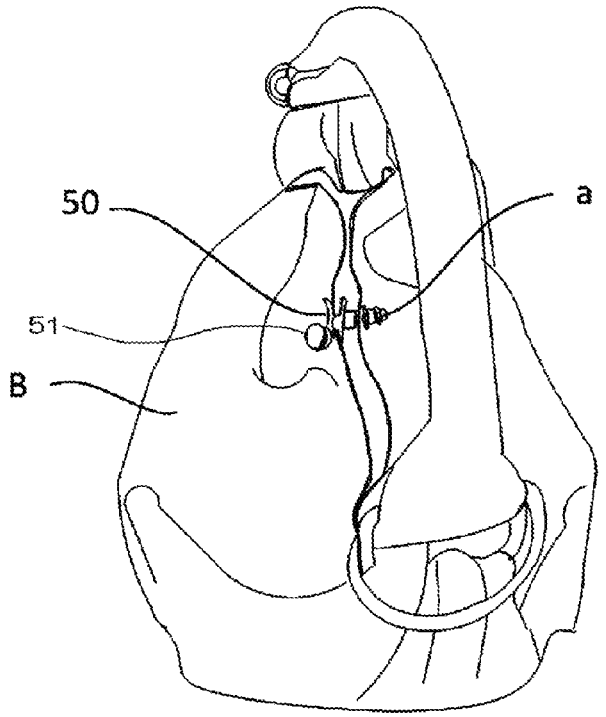
FIG. 28 is an explanatory view showing a using state of the fastening member shown in FIG. 27.

FIG. 27 is an explanatory view showing an example in which only one of the fastening members is used. FIG. 28 is an explanatory view showing a using state of the fastening member shown in FIG. 27. This fastening member a has a structure in which a magnet 1*a* is attached on the surface of the substrate 1. The fastening member a is attached to the opening portion of a handbag B or the like, by using the same method as described above. Moreover, a clip 50 made of a magnetic material is held at a position opposed to the fastening member a. The clip 50, which is made of a magnetic material, is attracted by the magnet 1*a* of the fastening member and fixed thereon. An accessory 51 may be attached to one of the surfaces of the clip 50. Additionally, the shape of the clip 50 is not limited by the one shown in FIG. 27, as long as it has a surface that can be attracted by the magnet 1*a*.

REFERENCE SIGNS LIST

1 . . . substrate
2 . . . piercing needle
3 . . . pierce catch
4 . . . through hole
5 . . . bottom surface member
6 . . . casing
7 . . . holding member

The invention claimed is:

1. A fastening tool, comprising:

first and second substrates on which first and second piercing needles for penetrating a surface material are formed, respectively;

first and second pierce catches that are formed so as to correspond to the first and second substrates, and sandwich the first and second piecing needles, respectively;

a first detachable member formed on an outer periphery of the first pierce catch corresponding to the first substrate; and a second detachable member formed on the second substrate and having such a shape as to surround the first pierce catch, so that the first detachable member and the second detachable member are detachably attached to each other and are configured by a combination of mutual magnets or a magnet and a magnetic member.

2. The fastening tool according to claim 1, further comprising:

detachable means for accessories, wherein said detachable means is formed on the first pierce catch or the first substrate.

* * * * *